US011426639B2

(12) United States Patent
James et al.

(10) Patent No.: US 11,426,639 B2
(45) **Date of Patent: *Aug. 30, 2022**

(54) GOLF CLUB

(71) Applicant: Taylor Made Golf Company, Inc., Carlsbad, CA (US)

(72) Inventors: Andrew James, Carlsbad, CA (US); Todd P. Beach, Encinitas, CA (US); Matthew David Johnson, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 199 days.

This patent is subject to a terminal disclaimer.

(21) Appl. No.: 16/815,361

(22) Filed: Mar. 11, 2020

(65) Prior Publication Data

US 2020/0282270 A1 Sep. 10, 2020

Related U.S. Application Data

(63) Continuation of application No. 15/926,824, filed on Mar. 20, 2018, now Pat. No. 10,610,747, which is a (Continued)

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 53/0408* (2020.08); *A63B 53/0433* (2020.08); *A63B 53/0462* (2020.08)

(58) Field of Classification Search
CPC ..... A63B 53/0466; A63B 60/52
See application file for complete search history.

(56) References Cited

U.S. PATENT DOCUMENTS 411,000 A 9/1889 Anderson
1,133,129 A 3/1915 Govan
(Continued)

FOREIGN PATENT DOCUMENTS

CN 2436182 6/2001
CN 201353407 12/2009
(Continued)

OTHER PUBLICATIONS

Adams Golf Speedline F11 Ti 14.5 degree fairway wood (www.bombsquadgolf.com, posted Oct. 18, 2010).
(Continued)

*Primary Examiner* — Eugene L Kim
*Assistant Examiner* — Christopher Glenn
(74) *Attorney, Agent, or Firm* — Klarquist Sparkman, LLP

(57) ABSTRACT

A golf club head comprises a face and a golf club head body. The face includes a toe end, a heel end, a crown end, and a sole end. The face defines a thickness from an outer surface to an inner surface of the face. The face defines a leading edge, the leading edge being the forwardmost edge of the face. The golf club head body is defined by a crown, a sole, and a skirt. The crown is coupled to the crown end of the face. The sole is coupled to the sole end of the face. The skirt is coupled to the sole and the crown. The golf club head body defines a trailing edge, the trailing edge being the rearwardmost edge of the golf club head body.

20 Claims, 16 Drawing Sheets

Related U.S. Application Data continuation of application No. 14/565,311, filed on Dec. 9, 2014, now Pat. No. 9,943,734.

(60) Provisional application No. 61/922,548, filed on Dec. 31, 2013.

(56) References Cited

U.S. PATENT DOCUMENTS 1,518,316 A 12/1924 Ellingham
1,526,438 A 2/1925 Scott
1,538,312 A 5/1925 Beat
1,592,463 A 7/1926 Marker
1,658,581 A 2/1928 Tobia
1,704,119 A 3/1929 Buhrke
1,705,997 A 3/1929 Quynn
1,970,409 A 8/1934 Wiedemann
D107,007 S 11/1937 Cashmore
2,122,020 A 6/1938 Bedi
2,198,981 A 4/1940 Sullivan
2,214,356 A 9/1940 Wettlaufer
2,225,930 A 12/1940 Sexton
2,360,364 A 10/1944 Reach
2,375,249 A 5/1945 Richer
2,460,435 A 2/1949 Schaffer
2,460,445 A 2/1949 Bigler
2,681,523 A 6/1954 Sellers
3,064,980 A 11/1962 Steiner
3,212,738 A 10/1965 Bradley et al.
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,860,244 A 1/1975 Cosby
3,897,066 A 7/1975 Belmont
3,976,299 A 8/1976 Lawrence et al.
3,979,122 A 9/1976 Belmont
3,979,123 A 9/1976 Belmont
4,008,896 A 2/1977 Gordo
4,043,563 A 8/1977 Churchward
4,052,075 A 10/1977 Daly
4,076,254 A 2/1978 Nygren
4,085,934 A * 4/1978 Churchward ..... A63B 53/04 473/338
4,121,832 A 10/1978 Ebbing
4,150,702 A 4/1979 Holmes
4,189,976 A 2/1980 Becker
4,214,754 A 7/1980 Zebelean
4,262,562 A 4/1981 MacNeill
D259,698 S 6/1981 MacNeill
4,322,083 A 3/1982 Imai
4,340,229 A 7/1982 Stuff, Jr.
4,411,430 A 10/1983 Dian
4,423,874 A 1/1984 Stuff, Jr.
4,438,931 A 3/1984 Motomiya
4,465,221 A 8/1984 Schmidt
4,471,961 A 9/1984 Masghati et al.
4,489,945 A 12/1984 Kobayashi
4,530,505 A 7/1985 Stuff
D284,346 S 6/1986 Masters
4,602,787 A 7/1986 Sugioka et al.
4,607,846 A 8/1986 Perkins
4,712,798 A 12/1987 Preato
4,730,830 A 3/1988 Tilley
4,736,093 A 4/1988 Braly
4,754,977 A 7/1988 Sahm
4,762,322 A 8/1988 Molitor et al.
4,795,159 A 1/1989 Nagamoto
4,803,023 A 2/1989 Enomoto et al.
4,809,983 A 3/1989 Langert
4,826,172 A 5/1989 Antonious
4,867,457 A 9/1989 Lowe
4,867,458 A 9/1989 Sumikawa et al.
4,869,507 A 9/1989 Sahm
4,890,840 A 1/1990 Kobayashi
4,895,371 A 1/1990 Bushner
4,915,558 A 4/1990 Muller
4,962,932 A 10/1990 Anderson
4,994,515 A 2/1991 Washiyama et al.
5,000,454 A 3/1991 Soda
5,006,023 A 4/1991 Kaplan
5,014,993 A 5/1991 Antonious
5,020,950 A 6/1991 Ladouceur
5,028,049 A 7/1991 McKeighen
5,039,267 A 8/1991 Wollar
5,042,806 A 8/1991 Helmstetter
5,050,879 A 9/1991 Sun et al.
5,058,895 A 10/1991 Igarashi
5,078,400 A 1/1992 Desbiolles et al.
5,121,922 A 6/1992 Harsh, Sr.
5,122,020 A 6/1992 Bedi
5,205,560 A 4/1993 Hoshi et al.
5,232,224 A 8/1993 Zeider
5,244,210 A 9/1993 Au
5,251,901 A 10/1993 Solheim et al.
5,253,869 A 10/1993 Dingle et al.
D343,558 S 1/1994 Latraverse et al.
5,297,794 A 3/1994 Lu
5,306,008 A 4/1994 Kinoshita
5,316,305 A 5/1994 McCabe
5,320,005 A 6/1994 Hsiao
5,328,176 A 7/1994 Lo
5,346,216 A 9/1994 Aizawa
5,346,217 A 9/1994 Tsuchiya et al.
5,385,348 A 1/1995 Wargo
5,395,113 A 3/1995 Antonious
5,410,798 A 5/1995 Lo
5,419,556 A 5/1995 Take
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,449,260 A 9/1995 Whittle
5,451,058 A 9/1995 Price et al.
D365,615 S 12/1995 Shimatani
5,518,243 A 5/1996 Redman
5,533,730 A 7/1996 Ruvang
5,564,705 A 10/1996 Kobayashi et al.
5,571,053 A 11/1996 Lane
5,573,467 A 11/1996 Chou et al.
5,582,553 A 12/1996 Ashcraft et al.
5,613,917 A 3/1997 Kobayashi et al.
5,620,379 A 4/1997 Borys
5,624,331 A 4/1997 Lo et al.
5,629,475 A 5/1997 Chastonay
5,632,694 A 5/1997 Lee
5,658,206 A 8/1997 Antonious
5,669,827 A 9/1997 Nagamoto
5,681,228 A 10/1997 Mikame et al.
5,683,309 A 11/1997 Reimers
5,688,189 A 11/1997 Bland
5,709,613 A 1/1998 Sheraw
5,709,615 A 1/1998 Liang
5,718,641 A 2/1998 Lin
5,720,674 A 2/1998 Galy
D392,526 S 3/1998 Nicely
5,735,754 A 4/1998 Antonious
5,746,664 A 5/1998 Reynolds, Jr.
5,755,627 A 5/1998 Yamazaki et al.
5,762,567 A 6/1998 Antonious
5,766,095 A 6/1998 Antonious
5,769,737 A 6/1998 Holladay et al.
5,776,010 A 7/1998 Helmstetter et al.
5,776,011 A 7/1998 Su et al.
5,788,587 A 8/1998 Tseng
5,798,587 A 8/1998 Lee
RE35,955 E 11/1998 Lu

(56) References Cited

U.S. PATENT DOCUMENTS 5,851,160 A 12/1998 Rugge et al.
D409,463 S 5/1999 McMullin
5,908,356 A 6/1999 Nagamoto
5,911,638 A 6/1999 Parente et al.
5,913,735 A 6/1999 Kenmi
5,916,042 A 6/1999 Reimers
D412,547 S 8/1999 Fong
5,935,019 A 8/1999 Yamamoto
5,935,020 A 8/1999 Stites et al.
5,941,782 A 8/1999 Cook
5,947,840 A 9/1999 Ryan
5,967,905 A 10/1999 Nakahara et al.
5,971,867 A 10/1999 Galy
5,976,033 A 11/1999 Takeda
5,997,415 A 12/1999 Wood
6,015,354 A 1/2000 Ahn et al.
6,017,177 A 1/2000 Lanham
6,019,686 A 2/2000 Gray
6,023,891 A 2/2000 Robertson et al.
6,030,293 A 2/2000 Takeda
6,032,677 A 3/2000 Blechman et al.
6,033,318 A 3/2000 Drajan, Jr. et al.
6,033,321 A 3/2000 Yamamoto
6,045,456 A 4/2000 Best
6,056,649 A 5/2000 Imai
6,062,988 A 5/2000 Yamamoto
6,077,171 A 6/2000 Yoneyama
6,077,173 A 6/2000 Stites
6,089,994 A 7/2000 Sun
6,123,627 A 9/2000 Antonious
6,139,445 A 10/2000 Werner et al.
6,149,533 A 11/2000 Finn
6,162,132 A 12/2000 Yoneyama
6,162,133 A 12/2000 Peterson
6,171,204 B1 1/2001 Starry
6,186,905 B1 2/2001 Kosmatka
6,190,267 B1 2/2001 Marlowe et al.
6,193,614 B1 2/2001 Sasamoto et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,238,303 B1 5/2001 Fite
6,244,974 B1 6/2001 Hanberry, Jr.
6,248,025 B1 6/2001 Murphy et al.
6,254,494 B1 7/2001 Hasebe et al.
6,264,414 B1 7/2001 Hartmann et al.
6,270,422 B1 8/2001 Fisher
6,277,032 B1 8/2001 Smith
6,290,609 B1 9/2001 Takeda
6,296,579 B1 10/2001 Robinson
6,299,547 B1 10/2001 Kosmatka
6,306,048 B1 10/2001 McCabe et al.
6,309,311 B1 10/2001 Lu
6,319,149 B1 11/2001 Lee
6,319,150 B1 11/2001 Werner et al.
6,334,817 B1 1/2002 Ezawa et al.
6,338,683 B1 1/2002 Kosmatka
6,340,337 B2 1/2002 Hasebe et al.
6,344,000 B1 2/2002 Hamada
6,344,002 B1 2/2002 Kajita
6,348,012 B1 2/2002 Erickson et al.
6,348,013 B1 2/2002 Kosmatka
6,348,014 B1 2/2002 Chiu
6,364,788 B1 4/2002 Helmstetter et al.
6,379,264 B1 4/2002 Forzano
6,379,265 B1 4/2002 Hirakawa et al.
6,383,090 B1 5/2002 O'Doherty et al.
6,386,987 B1 5/2002 Lejeune, Jr.
6,386,990 B1 5/2002 Reyes et al.
6,390,933 B1 5/2002 Galloway
6,409,612 B1 6/2002 Evans et al.
6,425,832 B2 7/2002 Cackett et al.
6,428,427 B1 * 8/2002 Kosmatka ..... A63B 53/04 473/331
6,434,811 B1 8/2002 Helmstetter et al.
6,436,142 B1 8/2002 Paes et al.
6,440,009 B1 8/2002 Guibaud et al.
6,440,010 B1 8/2002 Deshmukh
6,443,851 B1 9/2002 Liberatore
6,454,665 B2 9/2002 Antonious
6,458,044 B1 10/2002 Vincent et al.
6,461,249 B2 10/2002 Liberatore
6,471,604 B2 10/2002 Hocknell et al.
6,475,101 B2 11/2002 Burrows
6,475,102 B2 11/2002 Helmstetter et al.
6,478,692 B2 11/2002 Kosmatka
6,491,592 B2 12/2002 Cackett et al.
6,506,129 B2 1/2003 Chen
6,508,978 B1 1/2003 Deshmukh
6,514,154 B1 2/2003 Finn
6,524,197 B2 2/2003 Boone
6,524,198 B2 2/2003 Takeda
6,527,649 B1 3/2003 Neher et al.
6,530,848 B2 3/2003 Gillig
6,533,679 B1 3/2003 McCabe et al.
6,547,676 B2 4/2003 Cackett et al.
6,558,273 B2 5/2003 Kobayashi et al.
6,565,448 B2 5/2003 Cameron et al.
6,565,452 B2 5/2003 Helmstetter et al.
6,569,029 B1 5/2003 Hamburger
6,569,040 B2 5/2003 Bradstock
6,572,489 B2 6/2003 Miyamoto et al.
6,575,845 B2 6/2003 Galloway et al.
6,582,323 B2 6/2003 Soracco et al.
6,592,468 B2 7/2003 Vincent et al.
6,602,149 B1 8/2003 Jacobson
6,605,007 B1 8/2003 Bissonnette et al.
6,607,451 B2 8/2003 Kosmatka
6,607,452 B2 8/2003 Helmstetter et al.
6,612,938 B2 9/2003 Murphy et al.
6,616,547 B2 9/2003 Vincent et al.
6,638,180 B2 10/2003 Tsurumaki
6,638,183 B2 10/2003 Takeda
6,641,487 B1 11/2003 Hamburger
6,641,490 B2 11/2003 Ellemor
6,648,772 B2 11/2003 Vincent et al.
6,648,773 B1 11/2003 Evans
6,652,387 B2 11/2003 Liberatore
6,663,506 B2 12/2003 Nishimoto et al.
6,669,571 B1 12/2003 Cameron et al.
6,669,577 B1 12/2003 Hocknell et al.
6,669,578 B1 12/2003 Evans
6,669,580 B1 12/2003 Cackett et al.
6,676,536 B1 1/2004 Jacobson
6,679,786 B2 1/2004 McCabe
6,688,989 B2 2/2004 Best
6,695,712 B1 2/2004 Iwata et al.
6,716,111 B2 4/2004 Liberatore
6,716,114 B2 4/2004 Nishio
6,719,510 B2 4/2004 Cobzaru
6,719,641 B2 4/2004 Dabbs et al.
6,739,982 B2 5/2004 Murphy et al.
6,739,983 B2 5/2004 Helmstetter et al.
6,743,118 B1 6/2004 Soracco
6,749,523 B1 6/2004 Forzano
6,757,572 B1 6/2004 Forest
6,758,763 B2 7/2004 Murphy et al.
6,773,360 B2 8/2004 Willett et al.
6,773,361 B1 8/2004 Lee
6,776,726 B2 8/2004 Sano
6,800,038 B2 10/2004 Willett et al.
6,805,643 B1 10/2004 Lin
6,808,460 B2 10/2004 Namiki
6,824,475 B2 11/2004 Burnett et al.
6,835,145 B2 12/2004 Tsurumaki
6,860,818 B2 3/2005 Mahaffey et al.
6,860,823 B2 3/2005 Lee
6,860,824 B2 3/2005 Evans
6,875,124 B2 4/2005 Gilbert et al.
6,875,129 B2 4/2005 Erickson et al.
6,881,158 B2 4/2005 Yang et al.

(56) References Cited

U.S. PATENT DOCUMENTS 6,881,159 B2 4/2005 Galloway et al.
6,887,165 B2 5/2005 Tsurumaki
6,890,267 B2 5/2005 Mahaffey et al.
6,904,663 B2 6/2005 Willett et al.
6,921,344 B2 7/2005 Gilbert et al.
6,923,734 B2 8/2005 Meyer
6,926,619 B2 8/2005 Helmstetter et al.
6,932,718 B2 8/2005 Nishitani
6,960,142 B2 11/2005 Bissonnette et al.
6,964,617 B2 11/2005 Williams
6,974,393 B2 12/2005 Caldwell et al.
6,988,960 B2 1/2006 Mahaffey et al.
6,991,558 B2 1/2006 Beach et al.
6,991,559 B2 1/2006 Yabu
D515,165 S 2/2006 Zimmerman et al.
6,997,820 B2 2/2006 Willett et al.
6,997,821 B2 2/2006 Galloway
7,004,852 B2 2/2006 Billings
7,025,692 B2 4/2006 Erickson et al.
7,025,695 B2 4/2006 Mitsuba
7,029,403 B2 4/2006 Rice et al.
7,077,762 B2 7/2006 Kouno et al.
7,101,289 B2 9/2006 Gibbs et al.
7,118,493 B2 10/2006 Galloway
7,121,956 B2 10/2006 Lo
7,137,905 B2 11/2006 Kohno
7,137,906 B2 11/2006 Tsunoda et al.
7,140,974 B2 11/2006 Chao et al.
7,147,572 B2 12/2006 Kohno
7,147,573 B2 12/2006 DiMarco
7,153,220 B2 12/2006 Lo
7,163,468 B2 1/2007 Gibbs et al.
7,166,038 B2 1/2007 Williams et al.
7,166,040 B2 1/2007 Hoffman et al.
7,166,041 B2 1/2007 Evans
7,169,060 B2 1/2007 Stevens et al.
7,179,034 B2 2/2007 Ladouceur
7,186,190 B1 3/2007 Beach et al.
7,189,169 B2 3/2007 Billings
7,198,575 B2 4/2007 Beach et al.
7,201,669 B2 4/2007 Stites et al.
7,207,899 B2 4/2007 Unaniti
7,223,180 B2 5/2007 Willett et al.
7,247,104 B2 7/2007 Poynor
7,252,600 B2 8/2007 Murphy et al.
7,255,654 B2 8/2007 Murphy et al.
7,267,620 B2 9/2007 Chao et al.
7,273,423 B2 9/2007 Imamoto
7,278,927 B2 10/2007 Gibbs et al.
7,294,064 B2 11/2007 Tsurumaki et al.
7,294,065 B2 11/2007 Liang et al.
7,377,860 B2 5/2008 Breier et al.
7,407,447 B2 8/2008 Beach et al.
7,419,441 B2 9/2008 Hoffman et al.
7,448,963 B2 11/2008 Beach et al.
7,452,285 B2 11/2008 Chao et al.
7,476,162 B2 1/2009 Stites
7,500,924 B2 3/2009 Yokota
7,520,820 B2 4/2009 Dimarco
7,530,901 B2 5/2009 Imamoto et al.
7,530,904 B2 5/2009 Beach et al.
7,540,811 B2 6/2009 Beach et al.
7,563,175 B2 7/2009 Nishitani et al.
7,568,985 B2 8/2009 Beach et al.
7,572,193 B2 8/2009 Yokota
7,578,753 B2 8/2009 Beach et al.
7,582,024 B2 9/2009 Shear
7,591,737 B2 9/2009 Gibbs et al.
7,591,738 B2 9/2009 Beach et al.
7,621,823 B2 11/2009 Beach et al.
7,628,707 B2 12/2009 Beach et al.
7,632,194 B2 12/2009 Beach et al.
7,632,196 B2 12/2009 Reed et al.
7,662,050 B2 2/2010 Gilbert et al.
7,662,051 B2 2/2010 Chen
D612,440 S 3/2010 Oldknow
7,674,189 B2 3/2010 Beach et al.
7,744,484 B1 6/2010 Chao
7,744,486 B2 6/2010 Hou et al.
7,753,806 B2 7/2010 Beach et al.
7,771,291 B1 8/2010 Willett et al.
7,789,913 B2 9/2010 Park et al.
7,798,913 B2 9/2010 Noble et al.
7,811,178 B2 10/2010 Davis
7,815,523 B2 10/2010 Knutson et al.
7,846,041 B2 12/2010 Beach et al.
7,857,711 B2 12/2010 Shear
7,857,713 B2 12/2010 Yokota
7,871,338 B2 1/2011 Nakano
7,887,431 B2 2/2011 Beach et al.
7,887,434 B2 2/2011 Beach et al.
7,946,931 B2 5/2011 Oyama
7,985,146 B2 7/2011 Lin
7,988,568 B2 8/2011 Stites et al.
8,012,038 B1 9/2011 Beach et al.
8,012,039 B2 9/2011 Greaney et al.
8,025,587 B2 9/2011 Beach et al.
8,070,623 B2 * 12/2011 Stites ..... A63B 53/0466 473/346
8,083,609 B2 12/2011 Burnett et al.
8,088,021 B2 1/2012 Albertsen et al.
8,088,025 B2 1/2012 Wahl et al.
8,118,689 B2 2/2012 Beach et al.
8,147,350 B2 4/2012 Beach et al.
8,157,672 B2 4/2012 Greaney et al.
8,167,737 B2 5/2012 Oyama
8,177,661 B2 5/2012 Beach et al.
8,206,244 B2 6/2012 Honea et al.
8,235,831 B2 8/2012 Beach et al.
8,235,844 B2 8/2012 Albertsen et al.
8,241,143 B2 8/2012 Albertsen et al.
8,241,144 B2 8/2012 Albertsen et al.
8,257,195 B1 9/2012 Erickson
8,262,498 B2 9/2012 Beach et al.
8,292,756 B2 10/2012 Greaney et al.
8,303,431 B2 11/2012 Beach et al.
8,328,661 B1 12/2012 Erickson
8,337,319 B2 12/2012 Sargent et al.
8,337,329 B2 12/2012 Wada
8,353,786 B2 1/2013 Beach et al.
8,398,503 B2 3/2013 Beach et al.
8,414,420 B1 4/2013 Erickson
8,425,346 B1 4/2013 Erickson
8,430,763 B2 * 4/2013 Beach ..... A63B 53/02 473/307
8,439,769 B2 * 5/2013 Rice ..... A63B 60/00 473/345
8,475,293 B2 7/2013 Morin et al.
8,496,541 B2 7/2013 Beach et al.
8,496,544 B2 7/2013 Curtis et al.
8,517,855 B2 8/2013 Beach et al.
8,517,860 B2 8/2013 Albertsen et al.
8,517,863 B2 8/2013 Wahl et al.
8,540,589 B2 9/2013 Bezilla et al.
8,562,457 B2 10/2013 Beach et al.
8,602,907 B2 12/2013 Beach et al.
8,616,999 B2 12/2013 Greaney et al.
8,622,847 B2 1/2014 Beach et al.
8,663,029 B2 3/2014 Beach et al.
8,695,487 B2 4/2014 Sakane et al.
8,696,487 B2 4/2014 Beach et al.
8,696,491 B1 4/2014 Myers
8,721,471 B2 5/2014 Albertsen et al.
8,727,900 B2 5/2014 Beach et al.
8,753,222 B2 6/2014 Beach et al.
8,758,153 B2 6/2014 Sargent et al.
8,801,541 B2 8/2014 Beach et al.
8,814,725 B2 8/2014 Wahl et al.
8,845,450 B2 9/2014 Beach et al.
8,876,622 B2 11/2014 Beach et al.
8,876,627 B2 11/2014 Beach et al.
8,888,607 B2 11/2014 Beach et al.
8,900,069 B2 12/2014 Beach et al.
8,900,070 B1 12/2014 Dawson et al.

(56) References Cited

U.S. PATENT DOCUMENTS 8,926,448 B1 1/2015 Ivanova et al.
8,956,240 B2 2/2015 Beach et al.
9,033,821 B2 5/2015 Beach et al.
9,211,451 B1 12/2015 Westrum et al.
9,320,948 B2 4/2016 Fossum
9,943,734 B2 4/2018 James et al.
10,610,747 B2 * 4/2020 James ..... A63B 60/00
2001/0012804 A1 * 8/2001 Matsunaga ..... A63B 60/00 473/345
2001/0049310 A1 12/2001 Cheng et al.
2001/0055995 A1 * 12/2001 Cackett ..... B21J 5/00 473/342
2002/0022535 A1 2/2002 Takeda
2002/0025861 A1 2/2002 Ezawa
2002/0032075 A1 3/2002 Vatsvog
2002/0055396 A1 5/2002 Nishimoto et al.
2002/0072434 A1 6/2002 Yabu
2002/0123394 A1 9/2002 Tsurumaki
2002/0137576 A1 9/2002 Dammen
2002/0160854 A1 10/2002 Beach et al.
2003/0032500 A1 2/2003 Nakahara et al.
2003/0064823 A1 * 4/2003 Yamamoto ..... A63B 53/04 473/345
2003/0130059 A1 7/2003 Billings
2003/0190975 A1 10/2003 Fagot
2004/0087388 A1 5/2004 Beach et al.
2004/0099538 A1 5/2004 Chao
2004/0157678 A1 8/2004 Kohno
2004/0176183 A1 9/2004 Tsurumaki
2004/0192463 A1 9/2004 Tsurumaki et al.
2004/0235584 A1 11/2004 Chao et al.
2004/0242343 A1 12/2004 Chao
2005/0101404 A1 5/2005 Long et al.
2005/0137024 A1 6/2005 Stites et al.
2005/0181884 A1 8/2005 Beach et al.
2005/0192118 A1 * 9/2005 Rice ..... A63B 60/42 473/342
2005/0239575 A1 10/2005 Chao et al.
2005/0239576 A1 10/2005 Stites et al.
2006/0035722 A1 2/2006 Beach et al.
2006/0058112 A1 3/2006 Haralason et al.
2006/0084525 A1 4/2006 Imamoto et al.
2006/0122004 A1 6/2006 Chen et al.
2006/0154747 A1 7/2006 Beach et al.
2006/0172821 A1 8/2006 Evans
2006/0240908 A1 10/2006 Adams et al.
2007/0026961 A1 2/2007 Hou
2007/0049417 A1 3/2007 Shear
2007/0105646 A1 5/2007 Beach et al.
2007/0105647 A1 5/2007 Beach et al.
2007/0105648 A1 5/2007 Beach et al.
2007/0105649 A1 5/2007 Beach et al.
2007/0105650 A1 5/2007 Beach et al.
2007/0105651 A1 5/2007 Beach et al.
2007/0105652 A1 5/2007 Beach et al.
2007/0105653 A1 5/2007 Beach et al.
2007/0105654 A1 5/2007 Beach et al.
2007/0105655 A1 5/2007 Beach et al.
2007/0117652 A1 5/2007 Beach et al.
2008/0146370 A1 6/2008 Beach et al.
2008/0161127 A1 * 7/2008 Yamamoto ..... A63B 60/00 473/345
2008/0261717 A1 10/2008 Hoffman et al.
2008/0280698 A1 11/2008 Hoffman et al.
2009/0088269 A1 4/2009 Beach et al.
2009/0088271 A1 4/2009 Beach et al.
2009/0137338 A1 5/2009 Kajita
2009/0163289 A1 6/2009 Chao
2009/0170632 A1 7/2009 Beach et al.
2009/0247316 A1 * 10/2009 De La Cruz ..... A63B 53/0466 473/306
2010/0029404 A1 2/2010 Shear
2010/0048316 A1 2/2010 Honea et al.
2010/0048321 A1 2/2010 Beach et al.
2010/0113176 A1 5/2010 Boyd et al.
2010/0120554 A1 * 5/2010 Yu ..... A63B 53/0466 473/345
2010/0190573 A1 7/2010 Boyd
2010/0292028 A1 11/2010 Boyd
2011/0009211 A1 * 1/2011 Chao ..... A63B 60/00 473/347
2011/0021284 A1 1/2011 Stites et al.
2011/0028238 A1 * 2/2011 Boyd ..... A63B 53/0466 473/345
2011/0143858 A1 * 6/2011 Peralta ..... A63B 53/04 473/335
2011/0151989 A1 6/2011 Golden et al.
2011/0151997 A1 6/2011 Shear
2011/0190073 A1 * 8/2011 Bennett ..... A63B 53/04 473/345
2011/0218053 A1 9/2011 Tang et al.
2011/0256954 A1 10/2011 Soracco
2011/0294599 A1 12/2011 Albertsen et al.
2012/0083362 A1 4/2012 Albertsen et al.
2012/0083363 A1 4/2012 Albertsen et al.
2012/0142447 A1 6/2012 Boyd et al.
2012/0142452 A1 6/2012 Burnett et al.
2012/0149491 A1 6/2012 Beach et al.
2012/0196701 A1 8/2012 Stites et al.
2012/0202615 A1 8/2012 Beach et al.
2012/0220387 A1 8/2012 Beach et al.
2012/0244960 A1 9/2012 Tang et al.
2012/0270676 A1 10/2012 Burnett et al.
2012/0277029 A1 11/2012 Albertsen et al.
2012/0277030 A1 11/2012 Albertsen et al.
2012/0289361 A1 11/2012 Beach et al.
2013/0137533 A1 5/2013 Franklin
2013/0150177 A1 6/2013 Takechi
2013/0190103 A1 * 7/2013 Rice ..... A63B 53/02 473/324
2014/0080629 A1 3/2014 Sargent et al.
2014/0274457 A1 9/2014 Beach et al.
2015/0011328 A1 1/2015 Harbert et al.
2015/0105177 A1 4/2015 Beach et al.
2015/0231453 A1 8/2015 Harbert et al.
2018/0272201 A1 9/2018 James et al.

FOREIGN PATENT DOCUMENTS

DE 9012884 9/1990
EP 0470488 B1 3/1995
EP 0617987 B1 11/1997
EP 1001175 A2 5/2000
GB 194823 12/1921
JP 57-157374 10/1982
JP 4180778 6/1992
JP 05-317465 12/1993
JP 06-126004 5/1994
JP 06-238022 8/1994
JP 6-304271 11/1994
JP 07-231957 9/1995
JP 09-028844 2/1997
JP 09-308717 12/1997
JP 09-327534 12/1997
JP 10-234902 9/1998
JP 10-248964 9/1998
JP 10-277187 10/1998
JP 11-009742 1/1999
JP 2000014841 1/2000
JP 2001054595 2/2001
JP 2001-129130 5/2001
JP 2001149514 6/2001
JP 2001170225 6/2001
JP 2001204856 7/2001
JP 2001321474 11/2001
JP 2001346918 12/2001
JP 2002003969 1/2002
JP 2002017910 1/2002
JP 2002052099 2/2002
JP 2002248183 9/2002
JP 2002253706 9/2002
JP 2003038691 2/2003

(56) References Cited

FOREIGN PATENT DOCUMENTS

| | | |
|---|---|---|
| JP | 2003126311 | 5/2003 |
| JP | 2003226952 | 8/2003 |
| JP | 2004174224 | 6/2004 |
| JP | 2004183058 | 7/2004 |
| JP | 2004222911 | 8/2004 |
| JP | 2004-261451 | 9/2004 |
| JP | 2004267438 | 9/2004 |
| JP | 2005028170 | 2/2005 |
| JP | 05-296582 | 10/2005 |
| JP | 2005-296458 | 10/2005 |
| JP | 05-323978 | 11/2005 |
| JP | 2006-320493 | 11/2006 |
| JP | 04128970 | 7/2008 |
| JP | 2009000281 | 1/2009 |
| WO | WO88/02642 | 4/1988 |
| WO | WO01/66199 | 9/2001 |
| WO | WO02/062501 | 8/2002 |
| WO | WO03/061773 | 7/2003 |
| WO | WO2004/043549 | 5/2004 |
| WO | WO2006/044631 | 4/2006 |

OTHER PUBLICATIONS

Callaway Golf, World's Straightest Driver: FT-i Driver downloaded from www.callawaygolf.com/ft%2Di/driver.aspx?lang=en on Apr. 5, 2007.
Declaration of Tim Reed, VP of R&D, Adams Golf, Inc., dated Dec. 7, 2012.
Final Office action from the U.S. Patent and Trademark Office in U.S. Appl. No. 13/117,530, dated May 10, 2012.
Jackson, Jeff, The Modern Guide to Golf Clubmaking, Ohio: Dynacraft Golf Products, Inc., copyright 1994, p. 237.
Nike Golf, Sasquatch 460, downloaded from www.nike.com/nikegolf/index.htm on Apr. 5, 2007.
Nike Golf, Sasquatch Sumo Squared Driver, downloaded from www.nike.com/nikegolf/index.htm on Apr. 5, 2007.
Office action from the Japanese Patent Office in Patent Application No. 2008-264880, dated Nov. 21, 2012.
Office action from the U.S. Patent and Trademark Office in U.S. Appl. No. 11/066,720, dated Aug. 15, 2007.
Office action from the U.S. Patent and Trademark Office in U.S. Appl. No. 12/002,003, dated Feb. 27, 2009.
Office action from the U.S. Patent and Trademark Office in U.S. Appl. No. 12/781,727, dated Aug. 5, 2010.
Office action from the U.S. Patent and Trademark Office in U.S. Appl. No. 13/117,530, dated Nov. 23, 2011.
Office action from the U.S. Patent and Trademark Office in U.S. Appl. No. 13/117,530, dated Dec. 7, 2012.
Office action from the U.S. Patent and Trademark Office in U.S. Appl. No. 13/117,530, dated Jun. 10, 2013.
Office action from the U.S. Patent and Trademark Office in U.S. Appl. No. 13/338,197, dated Jun. 5, 2014.
Office action from the U.S. Patent and Trademark Office in U.S. Appl. No. 13/401,690, dated May 23, 2012.
Office action from the U.S. Patent and Trademark Office in U.S. Appl. No. 13/401,690, dated Feb. 6, 2013.
Office action from the U.S. Patent and Trademark Office in U.S. Appl. No. 13/469,023, dated Jul. 31, 2012.
Office action from the U.S. Patent and Trademark Office in U.S. Appl. No. 13/469,031, dated Oct. 9, 2014.
Office action from the U.S. Patent and Trademark Office in U.S. Appl. No. 13/469,031, dated May 20, 2015.
Office action from the U.S. Patent and Trademark Office in U.S. Appl. No. 13/828,675, dated Jun. 30, 2014.
Office action from the U.S. Patent and Trademark Office in U.S. Appl. No. 13/960,692, dated Jan. 28, 2014.
Office action from the U.S. Patent and Trademark Office in U.S. Appl. No. 13/960,692, dated Jun. 30, 2014.
Office action from the U.S. Patent and Trademark Office in U.S. Appl. No. 13/975,106, dated Feb. 24, 2014.
Office action from the U.S. Patent and Trademark Office in U.S. Appl. No. 14/495,795, dated Jun. 15, 2015.
Office action from the U.S. Patent and Trademark Office in U.S. Appl. No. 14/701,476, dated Jun. 15, 2015.
Restriction Requirement from the U.S. Patent and Trademark Office in U.S. Appl. No. 11/066,720, dated Apr. 2, 2007.
Restriction Requirement from the U.S. Patent and Trademark Office in U.S. Appl. No. 13/117,530, dated Oct. 28, 2011.
Restriction Requirement from the U.S. Patent and Trademark Office in U.S. Appl. No. 13/469,031, dated Jun. 5, 2014.
Restriction Requirement from the U.S. Patent and Trademark Office in U.S. Appl. No. 13/960,692, dated Sep. 20, 2013.
Taylor Made Golf Company, Inc. Press Release, Burner Fairway Wood, www.tmag.com/media/pressreleases/2007/011807_burner_fairway_rescue.html, Jan. 26, 2007.
Taylor Made Golf Company Inc., R7 460 Drivers, downloaded from www.taylormadegolf.com/product_detail.asp?pID=14section=overview on Apr. 5, 2007.
Titleist 907D1, downloaded from www.tees2greens.com/forum/Uploads/Images/7ade3521-192b-4611-870b-395d.jpg on Feb. 1, 2007.

* cited by examiner

| | Total Distance Face Map Stdev [yds] | Face Mass [g] |
|---|---|---|
| No Slot, Constant 1.9mm | 6.6 | 18.8 |
| Constant 1.9mm | 5.8 | 18.8 |
| Constant 2.4mm | 3.4 | 23.8 |
| Face Insert 4000 @ 1.9mm | 2.2 | 20.7 |

| Face Insert 4000 Mass Difference vs. | [g] |
|---|---|
| 2.4mm Constant [g] | 3.1 |
| 1.9mm Constant [g] | -1.9 |

FIG.11

| Spin | Constant 1.9mm | Constant 2.4mm | No Slot, Constant 1.9mm | Face Insert 4000 |
|---|---|---|---|---|
| Heel (-7.5, 0) | 3294 | 3715 | 3442 | 3727 |
| Low (0, -5) | 4171 | 4327 | 4565 | 4161 |
| CF (0, 0) | 3190 | 3649 | 3394 | 3688 |
| High (0, 5) | 2565 | 3193 | 2677 | 3508 |
| Toe (7.5, 0) | 3267 | 3678 | 3414 | 3610 |
| **Launch Angle** | Constant 1.9mm | Constant 2.4mm | No Slot, Constant 1.9mm | Face Insert 4000 |
| Heel (-7.5, 0) | 12.1 | 11.8 | 12.2 | 11.7 |
| Low (0, -5) | 10.6 | 10.3 | 10.4 | 10.4 |
| CF (0, 0) | 12.3 | 11.9 | 12.3 | 11.9 |
| High (0, 5) | 13.6 | 13.3 | 13.7 | 12.9 |
| Toe (7.5, 0) | 12.3 | 11.9 | 12.3 | 11.9 |
| **Ball Speed** | Constant 1.9mm | Constant 2.4mm | No Slot, Constant 1.9mm | Face Insert 4000 |
| Heel (-7.5, 0) | 150.0 | 149.3 | 149.6 | 149.4 |
| Low (0, -5) | 150.7 | 150.4 | 150.2 | 150.3 |
| CF (0, 0) | 151.8 | 151.0 | 151.2 | 151.0 |
| High (0, 5) | 149.1 | 148.3 | 148.7 | 148.3 |
| Toe (7.5, 0) | 150.2 | 149.5 | 149.8 | 149.6 |

FIG. 12

| Total | Constant 1.9mm | Constant 2.4mm | No Slot, Constant 1.9mm | Face Insert 4000 |
|---|---|---|---|---|
| Heel (-7.5, 0) | 254.6 | 248.2 | 252.1 | 248.3 |
| Low (0, -5) | 245.4 | 243.3 | 240.5 | 244.8 |
| CF (0, 0) | 259.2 | 252.0 | 255.6 | 251.5 |
| High (0, 5) | 262.6 | 252.9 | 260.5 | 249.1 |
| Toe (7.5, 0) | 254.8 | 248.8 | 252.3 | 249.8 |
| **Bounce & Roll** | Constant 1.9mm | Constant 2.4mm | No Slot, Constant 1.9mm | Face Insert 4000 |
| Heel (-7.5, 0) | 14.5 | 13.0 | 13.8 | 13.0 |
| Low (0, -5) | 12.3 | 12.1 | 11.4 | 12.6 |
| CF (0, 0) | 14.6 | 13.0 | 13.6 | 12.8 |
| High (0, 5) | 17.5 | 14.0 | 16.6 | 13.0 |
| Toe (7.5, 0) | 14.6 | 13.1 | 13.9 | 13.4 |
| **Carry** | Constant 1.9mm | Constant 2.4mm | No Slot, Constant 1.9mm | Face Insert 4000 |
| Heel (-7.5, 0) | 240.2 | 235.2 | 238.3 | 235.3 |
| Low (0, -5) | 233.1 | 231.2 | 229.1 | 232.2 |
| CF (0, 0) | 244.7 | 239.0 | 242.0 | 238.7 |
| High (0, 5) | 245.1 | 238.9 | 243.9 | 236.1 |
| Toe (7.5, 0) | 240.2 | 235.7 | 238.5 | 236.4 |
| **Peak Traj.** | Constant 1.9mm | Constant 2.4mm | No Slot, Constant 1.9mm | Face Insert 4000 |
| Heel (-7.5, 0) | 32.6 | 33.2 | 33.1 | 33.2 |
| Low (0, -5) | 32.7 | 32.3 | 33.2 | 31.8 |
| CF (0, 0) | 33.4 | 34.0 | 34.1 | 34.2 |
| High (0, 5) | 31.6 | 34.1 | 32.4 | 34.8 |
| Toe (7.5, 0) | 32.6 | 33.3 | 33.2 | 33.2 |

FIG. 15

GOLF CLUB

CROSS-REFERENCE TO RELATED APPLICATIONS

This application is a continuation of U.S. patent application Ser. No. 15/926,824, filed Mar. 20, 2018, now U.S. Pat. No. 10,610,747, issued Apr. 7, 2020, which is a continuation of U.S. patent application Ser. No. 14/565,311, filed Dec. 9, 2014, now U.S. Pat. No. 9,943,734, issued Apr. 17, 2018, which claims the benefit of U.S. Provisional Patent Application No. 61/922,548, filed Dec. 31, 2013, all of which are hereby incorporated by reference in their entirety.

This application references U.S. patent application Ser. No. 13/338,197, filed Dec. 27, 2011, entitled "Fairway Wood Center of Gravity Projection," which is incorporated by reference herein in its entirety and with specific reference to slot technology described therein. This application also references U.S. patent application Ser. No. 12/813,442, filed Jun. 10, 2010, now U.S. Pat. No. 8,801,541, entitled "Golf Club" which is incorporated by reference herein in its entirety and with specific reference to variable face thickness. This application also references U.S. patent application Ser. No. 12/791,025, filed Jun. 1, 2010, now U.S. Pat. No. 8,235,844, entitled "Hollow Golf Club Head," which is incorporated by reference herein in its entirety and with specific reference to slot technology described therein. This application also references U.S. patent application Ser. No. 13/839,727, filed Mar. 15, 2013, entitled "Golf Club with Coefficient of Restitution Feature," which is incorporated by reference herein in its entirety and with specific reference to slot technology and discussion of center of gravity location in golf club heads. This application also references U.S. patent application Ser. No. 12/687,003, filed Jan. 10, 2013, now U.S. Pat. No. 8,303,431, entitled "Golf Club," which is incorporated by reference herein in its entirety and with specific reference to flight control technology. This application also references U.S. patent application Ser. No. 10/290,817, filed Nov. 8, 2004, now U.S. Pat. No. 6,773,360, entitled "Golf Club Head Having a Removable Weight," which is incorporated by reference herein in its entirety and with specific reference to removable weights technology. This application also references U.S. patent application Ser. No. 11/647,797, filed Dec. 28, 2006, now U.S. Pat. No. 7,452,285, entitled "Weight Kit for Golf Club Head," which is incorporated by reference herein in its entirety and with specific reference to removable weights technology. This application also references U.S. patent application Ser. No. 11/524,031, filed Sep. 19, 2006, now U.S. Pat. No. 7,744,484, entitled "Movable Weights for a Golf Club Head," which is incorporated by reference herein in its entirety and with specific reference to movable weights technology.

FIELD

This disclosure relates to golf clubs and golf club heads. More particularly, this disclosure relates to the distance of golf club heads.

BACKGROUND

In modern golf club head design, golf club manufacturers have been able to engineer golf club heads to push the limits of distance. Although driver type golf club heads have reached the United States Golf Association limit for maximum Coefficient of Restitution for several years, recent breakthroughs on golf club head design have allowed other types of golf club heads to approach that limit as well, especially fairway wood type and hybrid type golf club heads. Recent designs, however, have failed address some problems with the designs. Additionally, some of the advances may not be fully understood, and the ability to maximize user benefit in the design may be compromised by such misunderstanding.

SUMMARY

A golf club head comprises a face and a golf club head body. The face includes a toe end, a heel end, a crown end, and a sole end. The face defines a thickness from an outer surface to an inner surface of the face. The face defines a leading edge, the leading edge being the forwardmost edge of the face. The golf club head body is defined by a crown, a sole, and a skirt. The crown is coupled to the crown end of the face. The sole is coupled to the sole end of the face. The skirt is coupled to the sole and the crown. The golf club head body defines a trailing edge, the trailing edge being the rearwardmost edge of the golf club head body.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

FIG. 11 is a table comparing various embodiments shown in the graph of FIG. 10.

FIG. 12 is a table showing values for various shot features of the total distances shown in the graph of FIG. 10.

FIG. 15 is a table showing values for various shot features of the total distances shown in the graphs of FIGS. 10 and 14.

DETAILED DESCRIPTION

Figure 1A:
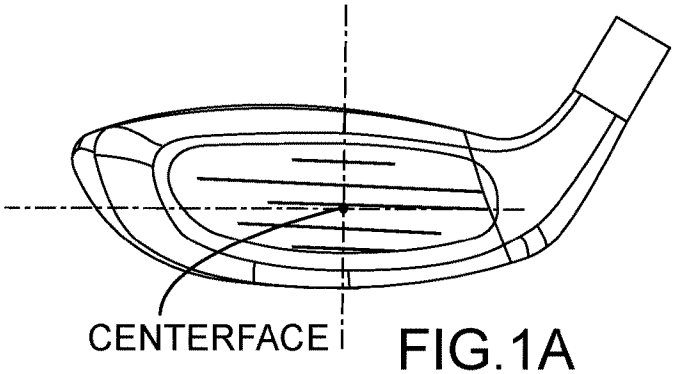
FIG. 1A is a heel side elevation view of a golf club head in accord with one embodiment of the current disclosure.

Disclosed is a golf club including a golf club head and associated methods, systems, devices, and various apparatus. It would be understood by one of skill in the art that the disclosed golf club and golf club head are described in but a few exemplary embodiments among many. No particular terminology or description should be considered limiting on the disclosure or the scope of any claims issuing therefrom.

Modern golf club design has brought the advent of extraordinary distance gains. Just two decades ago, golf tee shots over 250 yards were considered very long shots—among the longest possible—and unachievable for most amateur golfers. The advent of the metal wood head brought great possibilities to the golf industry. Just two decades later, golf technology applied to driver-type golf club heads allows many amateur golfers to achieve tee shots of greater than 300 yards. Modern golf courses have been designed longer than previously needed to address the distance gains, and many older courses have been renovated to add length in an attempt to maintain some of the difficulty of the game. The United States Golf Association (USGA) limited the Coefficient of Restitution (COR) for all golf club heads to 0.830. COR is a measure of collision efficiency. COR is the ratio of the velocity of separation to the velocity of approach. In this model, therefore, COR is determined using the following formula:

$$COR=(v_{club\text{-}post}-v_{ball\text{-}post})\div(v_{ball\text{-}pre}-v_{club\text{-}pre})$$

where, $v_{club\text{-}post}$ represents the velocity of the club after impact;

$v_{ball\text{-}post}$ represents the velocity of the ball after impact;

$v_{club\text{-}pre}$ represents the velocity of the club before impact (a value of zero for USGA COR conditions); and $v_{ball\text{-}pre}$ represents the velocity of the ball before impact.

Modern drivers achieved 0.830 COR several years ago, as the size of most drivers (reaching up to 460 cubic centimeters by USGA limit) allows engineers and designers the ability to maximize the size of the face of driver-type heads. However, fairway wood type and hybrid type golf club heads are designed with shallower heads—smaller heights as measured from the sole of the golf club head to the top of the crown of the golf club head—for several reasons. First, golfers typically prefer a smaller fairway wood type or hybrid type golf club head because the club may be used to strike a ball lying on the ground, whereas a driver-type golf club head is used primarily for a ball on a tee. When used for balls on the ground, most golfers feel it is easier to make consistent contact with a shallower golf club head than a driver-type golf club head. Second, the shallower profile of the golf club head helps keep the center of gravity of the golf club head low, which assists in lifting the ball off of the turf and producing a higher ball flight.

One drawback, however, is that the shallower height of the fairway wood type and hybrid type golf club heads often necessitates a smaller surface area of the face of the golf club head. Driver type golf club heads are able to reach the 0.830 COR limit primarily because the surface area of the face of modern driver type heads is relatively large. For fairway wood type and hybrid type golf club heads, the smaller surface area made design for distance difficult.

Relatively recent breakthroughs in golf club design—including the slot technology described in U.S. patent application Ser. No. 13/338,197, filed Dec. 27, 2011, entitled "Fairway Wood Center of Gravity Projection"—have allowed modern fairway woods type and hybrid type golf club heads to approach the 0.830 limit. Such advances have led to great distance gains for these types of clubs.

However, in addition to higher COR, it is now surprisingly understood that certain spin profile changes may occur as a result of the slot technology previously mentioned. Shots hit higher or lower on the golf club face may experience higher or lower spin rates relative to non-slotted versions of the same or similar golf club heads. Such spin variations can also affect the distance a ball travels off the golf club face. Finally, the placement of the weight in the golf club head can affect the launch angle—the angle at what the golf ball leaves the golf club head after impact—but launch angle may also be affected by the introduction of slot technology.

The result of these changes on golf club design cannot be overstated. The combination of spin, launch angle, and ball speed is determinative of many characteristics of the golf shot, including carry distance (the distance the ball flies in the air before landing), roll distance (the distance the ball continues to travel after landing), total distance (carry distance plus roll distance), and trajectory (the path the ball takes in the air), among many other characteristics of the shot.

Although distance gains were seen with the slot technology previously described, it was unclear exactly how those distance gains were achieved. Although COR was increased, the effect of the slot technology on launch angle and spin rates was not previously well understood.

As a result, fairway wood type and hybrid type golf club heads were able to achieve tremendous distance increases, but such distance increases were not necessarily consistent among all shot profiles. Although the COR of the golf club head may have been high in the center of the face, the COR may have been lower at other points on the face. Although large distance increases over prior models may have been seen with well struck shots or shots hit slightly low of center face, distance gains may not have been seen on shots that were not struck close to the center of the face.

For many players, inconsistency in distance is not a concern with a fairway wood type or hybrid type golf club head, as many players do not perceive these clubs as precision distance instruments. For those golfers, the ability to achieve maximum distance may be all that is needed, and the prior designs were able to give them greater distance than other fairway wood type and hybrid type golf clubs.

However, for many other players, the ability to hit a repeatable and consistent golf shot is paramount to scoring, even at the relatively long distances seen in fairway wood type and hybrid type golf club heads. Particularly for "better" or "stronger" players, the ability to hit a fairway wood type golf club head large distances is beneficial, but the reduction in distance for off-center strikes often obviates the benefit of such distance gains. For a player who reliably strikes a fairway wood over 250 yards, the ability to hit the ball the same distance on each strike may be of greater importance than the ability to hit the ball greater distances. Prior designs implementing slot technology may not have appealed to this player. For example, many PGA Tour professionals and top amateur players know expected distances—including carry distance and total distance—to within a yard or two for each club in their bags. Especially with respect to carry distance, the ability to hit a shot a reliable distance is of paramount importance to these players because a difference of a few yards in carry distance may result in the golfer playing his next shot from the green versus from a green-side bunker or another penal location. Therefore, such a player would not appreciate a club that resulted in great distance gaps between a center face strike and an off-center strike.

There are several methods to address a particular golfer's inability to strike the shot purely. One method involves the use of increased Moment of Inertia (MOI). Increasing MOI prevents the loss of energy for strikes that do not impact the center of the face by reducing the ability of the golf club head to twist on off-center strikes. Particularly, most higher-MOI designs focus on moving weight to the perimeter of the golf club head, which often includes moving a center of gravity of the golf club head back in the golf club head, toward a trailing edge.

Another method involves use of variable face thickness (VFT) technology. With VFT, the face of the golf club head is not a constant thickness across its entirety, but rather varies. For example, as described in U.S. patent application Ser. No. 12/813,442, filed Jun. 10, 2010, entitled "Golf Club"—which is incorporated herein by reference in its entirety—the thickness of the face varies in an arrangement with a dimension as measured from the center of the face. This allows the area of maximum COR to be increased as described in the reference.

While VFT is excellent technology, it can be difficult to implement in certain golf club designs. For example, in the design of fairway woods, the height of the face is often too small to implement a meaningful VFT design. Moreover, there are problems that VFT cannot solve. For example, because the edges of the typical golf club face are integrated (either through a welded construction or as a single piece), a strike that is close to an edge of the face necessarily results in poor COR. It is common for a golfer to strike the golf ball at a location on the golf club head other than the center of the face. Typical locations may be high on the face or low on the face for many golfers. Both situations result in reduced COR. However, particularly with low face strikes, COR decreases very quickly. In various embodiments, the COR for strikes 5 mm below center face may be 0.020 to 0.035 difference. Further off-center strikes may result in greater COR differences.

To combat the negative effects of off-center strikes, certain designs have been implemented. For example, as described in U.S. patent application Ser. Nos. 12/791,025, 13/338,197, and 13/839,727—all of which are incorporated by reference herein in their entirety—coefficient of restitution features located in various locations of the golf club head provide advantages. In particular, for strikes low on the face of the golf club head, the coefficient of restitution features allow greater flexibility than would typically otherwise be seen from a region low on the face of the golf club head. In general, the low point on the face of the golf club head is not ductile and, although not entirely rigid, does not experience the COR that may be seen in the geometric center of the face.

Although coefficient of restitution features allow for greater flexibility, they can often be cumbersome to implement. For example, in the designs above, the coefficient of restitution features are placed in the body of the golf club head but proximal to the face. While the close proximity enhances the effectiveness of the coefficient of restitution features, it creates challenges from a design perspective. Manufacturing the coefficient of restitution features may be difficult in some embodiments. Particularly with respect to U.S. patent application Ser. No. 13/338,197, the coefficient of restitution feature includes a sharp corner at the vertical extent of the coefficient of restitution feature that can experience extremely high stress under impact conditions. It may become difficult to manufacture such features without compromising their structural integrity in use. Further, the coefficient of restitution features necessarily extend into the golf club head body, thereby occupying space within the golf club head. The size and location of the coefficient of restitution features may make mass relocation difficult in various designs, particularly when it is desirous to locate mass in the region of the coefficient of restitution feature.

In particular, one challenge with current coefficient of restitution feature designs is the ability to locate the center of gravity (CG) of the golf club head proximal to the face. It has been desirous to locate the CG low in the golf club head, particularly in fairway wood type golf clubs. In certain types of heads, it may still be the most desirable design to locate the CG of the golf club head as low as possible regardless of its location within the golf club head. However, it has unexpectedly been determined that a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads have lofts of 13 degrees or greater, and, more usually, 15 degrees or greater. In general, driver type golf club heads have lofts of 12 degrees or less, and, more usually, of 10.5 degrees or less. In general, fairway wood type golf club heads have a length from leading edge to trailing edge of 73-97 mm. Various definitions distinguish a fairway wood type golf club head form a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Driver type golf club heads of the current disclosure may be 12 degrees or less in various embodiments or 10.5 degrees or less in various embodiments.

The golf club and golf club head designs of the current embodiment seek to address these problems in design by achieving more consistent distance profile over the entire face of the golf club head with minimal increase in weight. It is believed that by normalizing COR, a lower distance gap would result from heelward or toeward strikes or those strikes that are higher or lower on the golf club face. Although such normalized COR may not approach the 0.830 COR limit as closely as other designs, some distance gains would be seen by the inclusion of slot technology. Additionally, spin and launch angle are considered in conjunction with COR across face of the golf club head to provide the most consistent total distance for center and off-center strikes. Benefits are achieved through the combination of slot technology, VFT, and reduced weight, all of which combine to increase COR across the face in conjunction with spin and launch angle to reduce dispersion for off-center shots.

In further iterations, variations in the slot technology may allow spin reduction or increase on certain shots to address the desired flight and result. For example, a ball struck particularly low on the golf club face will generally begin its flight with a low launch angle, particularly if the golf club head includes a roll radius at the face portion. As such, it may be advantageous to provide increased spin rates for shots struck low on the golf club face to maintain carry distance. In another example, a ball struck particularly high on the golf club face will generally begin its flight with a higher launch angle. As such, it may be advantageous in some situations to provide decreased spin rates, or it may be advantageous to provide increased spin rates to prevent "flyer" shots—those that travel particularly long distances because of the inability of the golfer to spin the ball from a particular lie, such as in the rough.

Devices and systems of the current disclosure achieve altered COR profile across the face through variable face thickness (VFT) technology while achieving greater COR and greater distance gains than prior fairway wood type and hybrid type golf club heads through the use of slot technology.

One embodiment of a golf club head 100 is disclosed and described in with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club head body for the purposes of this disclosure. A coefficient of restitution feature (CORF) 300 is seen in the sole 130 of the golf club head 100.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

Figure 1C:
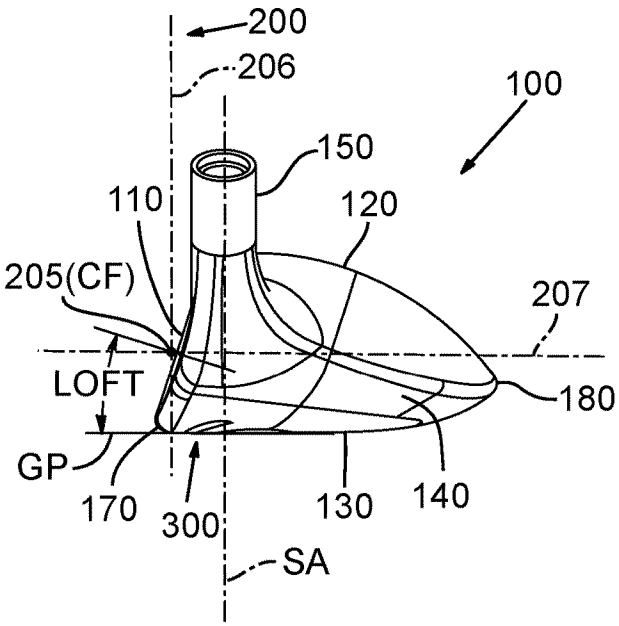
FIG. 1C is a top plan view of the golf club head of FIG. 1A.
Figure 1C:
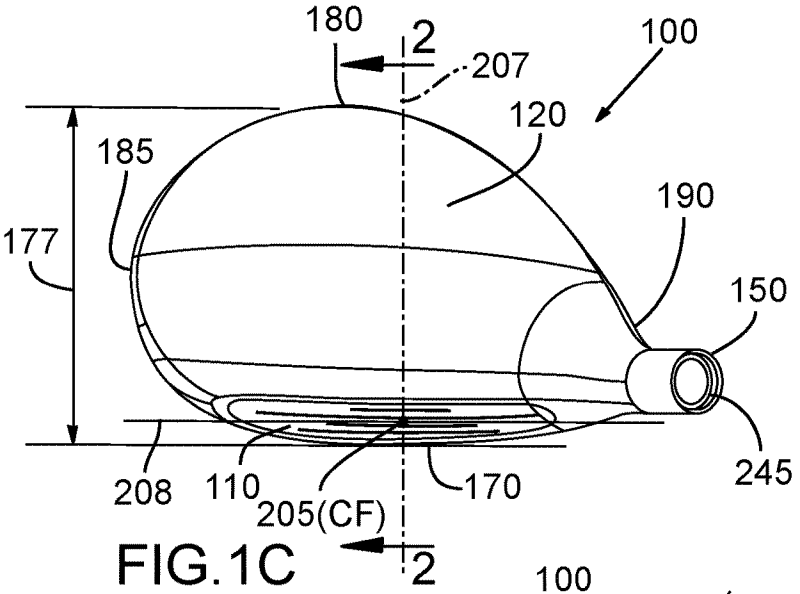
Figure 1B:
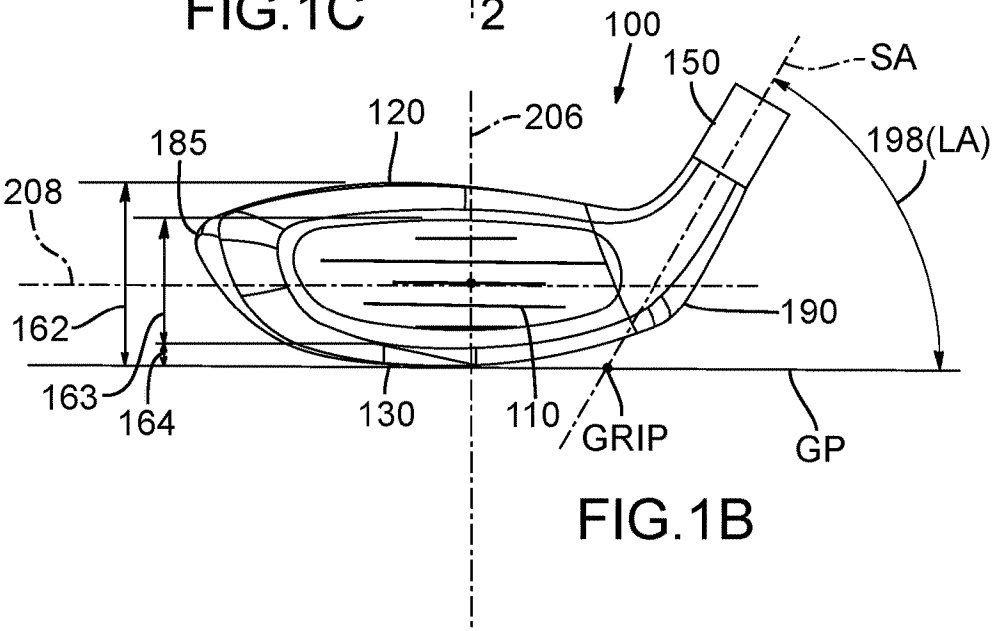
FIG. 1B is a front side elevation view of the golf club head of FIG. 1A.

As seen with reference to FIG. 1B, the x-axis 208 is parallel to a ground plane (GP) onto which the golf club head 100 may be properly soled—arranged so that the sole 130 is in contact with the GP. The y-axis 207 (FIG. 1A) is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 (FIG. 1C) defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP.

The top view seen in FIG. 1C shows another view of the golf club head 100. The shaft bore 245 can be seen defined in the hosel 150. The cutting plane for FIG. 2 can also be seen in FIG. 1D. The cutting plane for FIG. 2 coincides with the y-axis 207.

Referring back to FIG. 1B, a crown height 162 is shown and measured as the height from the GP to the highest point of the crown 120 as measured parallel to the z-axis 206. In the current embodiment, the crown height 162 is about 36 mm. In various embodiments, the crown height 162 may be 34-40 mm. In various embodiments, the crown height may be 32-44 mm. In various embodiments, the crown height may be 30-50 mm. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In the current embodiment, the effective face height 163 is about 25.5 mm. In various embodiments, the effective face height 163 may be 22-28 mm. In various embodiments, the effective face height 163 may be 2-7 mm less than the crown height 162. In various embodiments, the effective face height 163 may be 2-12 mm less than the crown height 162.

In the current embodiment the crown height 162 is about 36 mm. In various embodiments, the crown height 162 may be 30-40 mm. An effective face position height 164 is a height from the GP to the lowest point on the face 110 as measured in the direction of the z-axis 206. In the current embodiment, the effective face position height 164 is about 4 mm. In various embodiments, the effective face position height 164 may be 2-6 mm. In various embodiments, the effect face position height 164 may be 0-10 mm. A length 177 of the golf club head 177 as measured in the direction of the y-axis 207 is seen as well with reference to FIG. 1C. In the current embodiment, the length 177 is about 67 mm. In various embodiments, the length 177 may be 60-70 mm. In various embodiments, the length 177 may be 55-73 mm. The distance 177 is a measurement of the length from the leading edge 170 to the trailing edge 180. The distance 177 may be dependent on the loft of the golf club head in various embodiments. In one embodiment, the loft of the golf club head is about 17 degrees and the distance 177 is about 67.0 mm. In one embodiment, the loft of the golf club head is about 20 degrees. In one embodiment, the loft of the golf club head is about 23 degrees. In various embodiments, the distance 177 does not change for varying lofts, although in various embodiments the distance 177 may change by 10-15 mm.

Figure 1D:
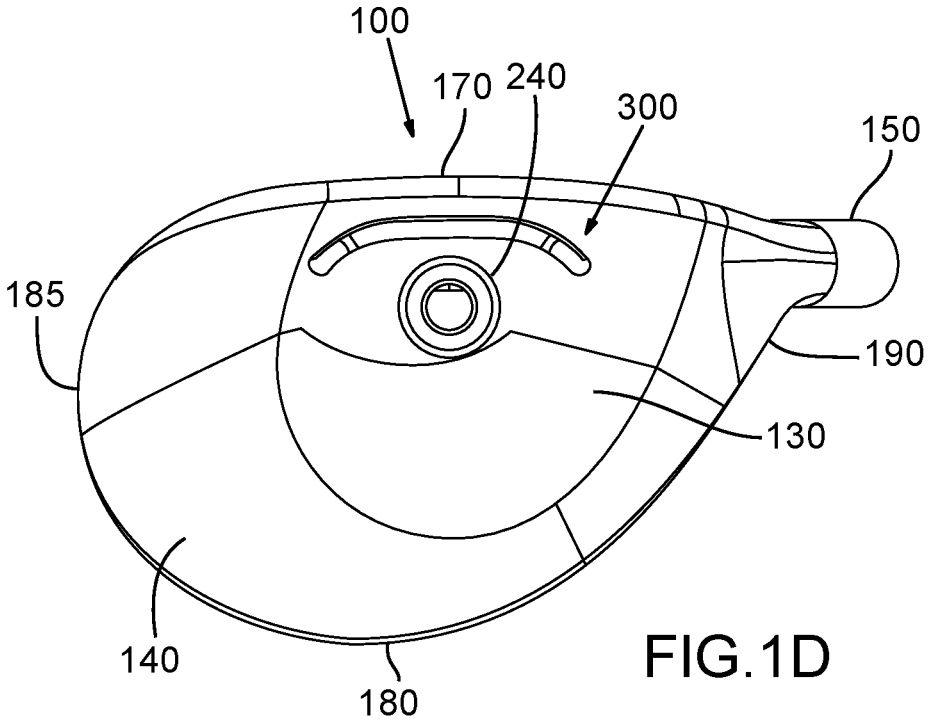
FIG. 1D is a bottom plan view of the golf club head of FIG. 1A.

As seen with reference to FIG. 1D, the coefficient of restitution feature 300 (CORF) is shown defined in the sole 130 of the golf club head 100. A modular weight port 240 is shown defined in the sole 130 for placement of removable weights. Various embodiments and systems of removable weights and their associated methods and apparatus are described in greater detail with reference to U.S. patent application Ser. Nos. 10/290,817, 11/647,797, 11/524,031, all of which are incorporated by reference herein in their entirety. Details of the CORF 300 are seen and described with reference to U.S. patent application Ser. No. 13/839,727, filed Mar. 15, 2013, entitled "Golf Club," which is incorporated by reference herein in its entirety and with specific reference to the discussion of the CORF.

Any coefficient of restitution feature of the current disclosure may be substantially the same as the embodiments disclosed in U.S. patent application Ser. No. 13/839,727. However, the CORF 300 of the current embodiment is shown and described with reference to the detail cross-sectional view of FIG. 2.

Figure 2:
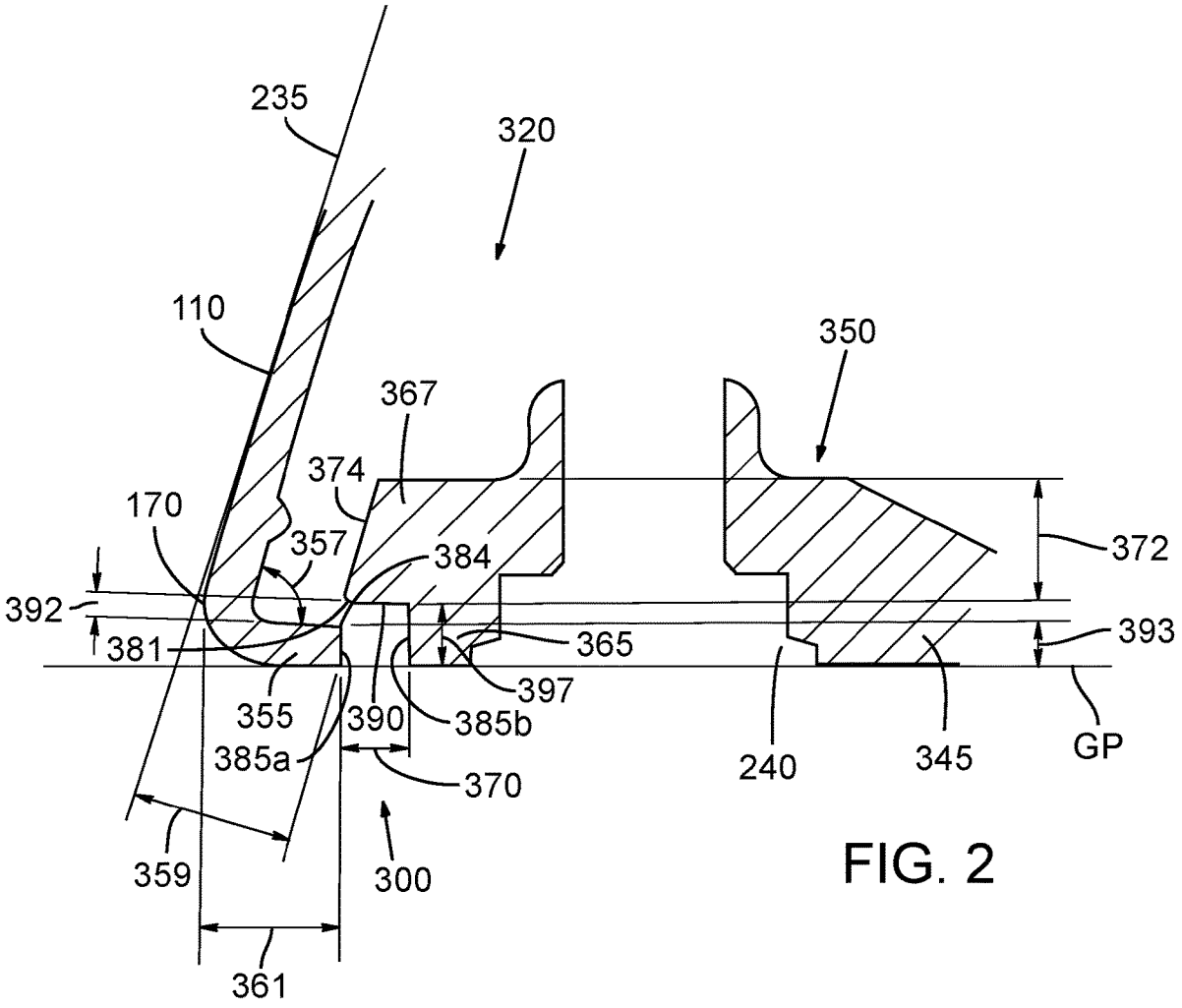
FIG. 2 is a detailed cross-sectional view of a portion of the golf club head of FIG. 1A, the cross-sectional view taken along the plane indicated by line 2-2 in FIG. 1C.

The CORF 300 of the current embodiment is defined proximate the leading edge 170 of the golf club head 100, as seen with reference to FIG. 2. The CORF 300 of the current embodiment is a through-slot providing a port from the exterior of the golf club head 100 to an interior 320. The CORF 300 is defined on one side by a first sole portion 355. The first sole portion 355 extends from a region proximate the face 110 to the sole 130 at an angle 357, which is acute in the current embodiment. In various embodiments, the first sole portion 355 is coplanar with the sole 130; in various embodiments, the first sole portion 355 may be in various arrangements. In various embodiments, the angle 357 may be 85-90 degrees. In various embodiments, the angle 357 may be 82-92 degrees. The first sole portion 355 extends from the face 110 a distance 359 of about 6.5 mm as measured orthogonal to a plane tangent to the face 110, termed the Tangent Face Plane 235 (TFP) in the current disclosure. The TFP 235 is a plane tangent to the face 110 at the origin 205 (at CF). The TFP 235 approximates a plane for the face 110, even though the face 110 is curved at a roll radius and a bulge radius. In various embodiments, the distance 359 may be 5-6 mm. In various embodiments, the distance 359 may be 4-7 mm. In various embodiments, the distance 359 may be up to 12.5 mm. The first sole portion 355 projects along the y-axis 207 the distance 361 as measured to the leading edge 170, which is about the same distance that a weight pad 350 is offset from the leading edge 170. In the current embodiment, the distance 361 is about 6.2 mm. In various embodiments, the distance 361 is 4.5-5.5 mm. In various embodiments, the distance 361 is 3-7 mm. In various embodiments, the distance 361 may be up to 10 mm. In the current embodiment, the distances 359,361 are measured at the cutting plane, which is coincident with the y-axis 207 and z-axis 206. In various embodiments, measurements—including angles and distances such as distances 359,361—may vary depending on the location where measured and as based upon the shape of the CORF 300.

The CORF 300 is defined over a distance 370 from the first sole portion 355 to a first weight pad portion 365 as measured along the y-axis. In the current embodiment, the distance 370 is about 3.0 mm. In various embodiments, the distance 370 may be larger or smaller. In various embodiments, the distance 370 may be 2.0-5.0 mm. In various embodiments, the distance 370 may be variable along the CORF 300.

The CORF 300 is defined distal the leading edge 170 by the first weight pad portion 365. The first weight pad portion 365 in the current embodiment includes various features to address the CORF 300 as well as a modular weight port 240 defined in the first weight pad portion 365. In various embodiments, the first weight pad portion 365 may be various shapes and sizes depending upon the specific results desired. In the current embodiment, the first weight pad portion 365 includes an overhang portion 367 over the CORF 300 along the y-axis 207. The overhang portion 367 includes any portion of the weight pad 350 that overhangs the CORF 300. For the entirety of the disclosure, overhang portions include any portion of weight pads overhanging the CORFs of the current disclosure. The overhang portion 367 includes a faceward most point 381 that is the point of the overhang portion 367 furthest toward the leading edge 170 as measured in the direction of the y-axis 207. In the current embodiment, the faceward most point 381 is part of a chamfered edge, although in various embodiments the edge may be various profiles.

The overhang portion 367 overhangs a distance that is about the same as the distance 370 of the CORF 300 in the current embodiment. In the current embodiment, the weight pad 350 (including the first weight pad portion 365 and a second weight pad portion 345) are designed to promote low center of gravity of the golf club head 100. A thickness 372 of the overhang portion 367 is shown as measured in the direction of the z-axis 206. The thickness 372 may determine how mass is distributed throughout the golf club head 100 to achieve desired center of gravity location. The overhang portion 367 includes a sloped end 374 that is about parallel to the face 110 (or, more appropriately, to the TFP 235) in the current embodiment, although the sloped end 374 need not be parallel to the face 110 in all embodiments. In various embodiments, the distance that the overhang portion 367 overhangs the CORF 300 may be smaller or larger, depending upon the desired characteristics of the design.

The CORF 300 includes a vertical surface 385 (shown as 385*a,b* in the current view) that defines the edges of the CORF 300. The CORF 300 also includes a termination surface 390 that is defined along a lower surface of the overhang portion 367. The termination surface 390 is offset a distance 392 from a low point 384 of the first sole portion 355. The offset distance 392 provides clearance for movement of the first sole portion 355, which may elastically or plastically deform in use, thereby reducing the distance 370 of the CORF 300. Because of the offset distance 392, the vertical surface 385 is not the same for vertical surface 385*a* and vertical surface 385*b*. However, the vertical surface 385 is continuous around the CORF 300. In the current embodiment, the offset distance 392 is about 1.0 mm. In various embodiments, the offset distance 392 may be 0.2-2.0 mm. In various embodiments, the offset distance 392 may be up to 4 mm. An offset to ground distance 393 is also seen as the distance between the low point 384 and the GP. The offset to ground distance 393 is about 1.8 mm in the current embodiment. The offset to ground distance 393 may be 2-3 mm in various embodiments. The offset to ground distance 393 may be up to 5 mm in various embodiments. A termination surface to ground distance 397 is also seen and is about 3.2 mm in the current embodiment. The termination surface to ground distance 397 may be 2.0-5.0 mm in various embodiments. The termination surface to ground distance 397 may be up to 10 mm in various embodiments.

In various embodiments, the vertical surface 385*b* may transition into the termination surface 390 via fillet, radius, bevel, or other transition. One of skill in the art would understand that, in various embodiments, sharp corners may not be easy to manufacture. In various embodiments, advantages may be seen from transitions between the vertical surface 385 and the termination surface 390. Relationships between these surfaces (385, 390) are intended to encompass these ideas in addition to the current embodiments, and one of skill in the art would understand that features such as fillets, radii, bevels, and other transitions may substantially fall within such relationships. For the sake of simplicity, relationships between such surfaces shall be treated as if such features did not exist, and measurements taken for the sake of relationships need not include a surface that is fully vertical or horizontal in any given embodiment.

The thickness 372 of the overhang portion 367 of the current embodiment can be seen. The thickness 372 in the current embodiment is about 6.7 mm. In various embodiments, the thickness 372 may be 3-5 mm. In various embodiments, the thickness 372 may be 2-10 mm. As shown with relation to other embodiments of the current disclosure, the thickness 372 may be greater if combined with features of those embodiments. As can be seen, each of the offset distance 392 and the offset to ground distance 393, and the termination surface to ground distance 397 is less than the thickness 372. As such, a ratio of each of the offset distance 392, the offset to ground distance 393, and the vertical surface height 394 to the thickness 372 is less than or equal to 1. In various embodiments, the CORF 300 may be characterized in terms of the termination surface to ground distance 397. For the sake of this disclosure, the ratio of termination surface to ground distance 397 as compared to the thickness 372 is termed the "CORF mass density ratio." While the CORF mass density ratio provides one potential characterization of the CORF, it should be noted that all ratios cited in this paragraph and throughout this disclosure with relation to dimensions of the various weight pads and CORFs may be utilized to characterize various aspects of the CORFs, including mass density, physical location of features, and potential manufacturability. In particular, the CORF mass density ratio and other ratios herein at least provide a method of describing the effectiveness of relocating mass to the area of the CORF, among other benefits.

The CORF 300 may also be characterized in terms of distance 370. A ratio of the offset distance 392 as compared to the distance 370 is about equal to 1 in the current embodiment and may be less than 1 in various embodiments.

In various embodiments, the CORF 300 may be plugged with a plugging material (not shown). Because the CORF 300 of the current embodiment is a through-slot (providing a void in the golf club head body), it is advantageous to fill the CORF 300 with a plugging material to prevent introduction of debris into the CORF 300 and to provide separation between the interior 320 and the exterior of the golf club head 100. Additionally, the plugging material may be chosen to reduce or to eliminate unwanted vibrations, sounds, or other negative effects that may be associated with a through-slot. The plugging material may be various materials in various embodiments depending upon the desired performance. In the current embodiment, the plugging material is polyurethane, although various relatively low modulus materials may be used, including elastomeric rubber, polymer, various rubbers, foams, and fillers. The plugging material should not substantially prevent elastic deformation of the golf club head 100 when in use. For example, a plugging material that reduced COR may be detrimental to the performance of the golf club head in certain embodiments, although such material may provide some benefits in alternative embodiments.

The introduction of a CORF such as CORF 300, as well as those described in U.S. patent application Ser. No. 13/839,727, provides increased COR on center face and low face shots as described In U.S. patent application Ser. No. 13/839,727 and specifically incorporated by reference herein. However, golfers do not experience inconsistent shots on the center line of the club face only. Golfers often mistakenly strike the ball heelward or toeward of the center face in addition to high and low on center face. Additionally, even with improvements seen by the introduction of a CORF, low face shots often do not travel sufficient distances to avoid severe penalties, such as forced carries over hazards.

Furthermore, with the increase of COR on center face strikes, well-struck shots in some embodiments may travel farther than well-struck shots of other designs that do not incorporate a CORF. Although some gains in distance may be seen on low face shots, the distances gained for low face shots many times are not as great as distance gains on well-struck shots with a CORF. As such, it is often true that the distance gap between a center face strike and a low face strike increases with introduction of a CORF.

To address the variance in distance, it may be advantageous to implement variable face thickness (VFT) or other methods to address different COR regions along the golf club face and to alter spin profiles of the various shots. For example, in various embodiments of golf club heads—such as golf club head 100—the face 110 of the golf club head 100 is connected to the golf club head 100 as a separate face insert. Various embodiments of face inserts are disclosed and utilized in accord with various discussion of the disclosure to achieve COR distribution around the face 110 of the golf club head 100 to promote consistent distance. One of skill in the art would understand that the various embodiments may be combined or modified as obvious to one of skill in the art, and no one embodiment should be considered limiting on the scope of this disclosure. One of skill in the art would also understand that the representations of face inserts are not intended to limit the disclosure only to separable pieces, and embodiments of various faces may be incorporated as face inserts (as described in detail herein) or may be integrated as one-piece embodiments with the body of the golf club head, among various other embodiments.

In many fairway wood-type and hybrid-type golf club heads, thickness of the face 110 remains about constant at most striking locations. As indicated above, such a face thickness arrangement can lead to variance between center strikes and off-center strikes, particularly with low face strikes. For example, in one hybrid of 18.7 degrees loft swung at 107 mph club head speed, a center face strike travels 254 yards without CORF or other distance-enhancing technology; the same club would experience nearly 10 yards shorter shot length with a strike 5 mm below center face, with shots traveling under 245 yards in some embodiments. The introduction of a CORF such as CORF 300 without additional modifications can make the distance drop more severe. For example, with a CORF, center face strikes travel 262 yards total. Although low face strike distance is improved by introduction of a CORF over a similar golf club head without a CORF, the increase may be as little as 3-4 yards, meaning that the difference between a center face strike and a strike 5 mm below center face could be as much as 14 yards.

In various embodiments, introduction of a CORF has improved total distance and distance on low face strikes, but, as illustrated above, the distance gaps may have widened. As such, it has surprisingly become desirable to reduce distance on center face strikes while maintaining improved distance on low face strikes to promote more consistent distance for off-center hits as compared to well-struck shots.

To achieve the desired performance, one solution among several disclosed herein involves introducing VFT as indicated above. The introduction of VFT can normalize distance between center face strikes and low face strikes by creating a more consistent COR pattern over the face 110. Among many element, various VFTs may achieve consistent distance by reducing center face strike distance while maintaining low face strike distance, thereby promoting consistent distance amongst the various strikes.

Figure 3A:
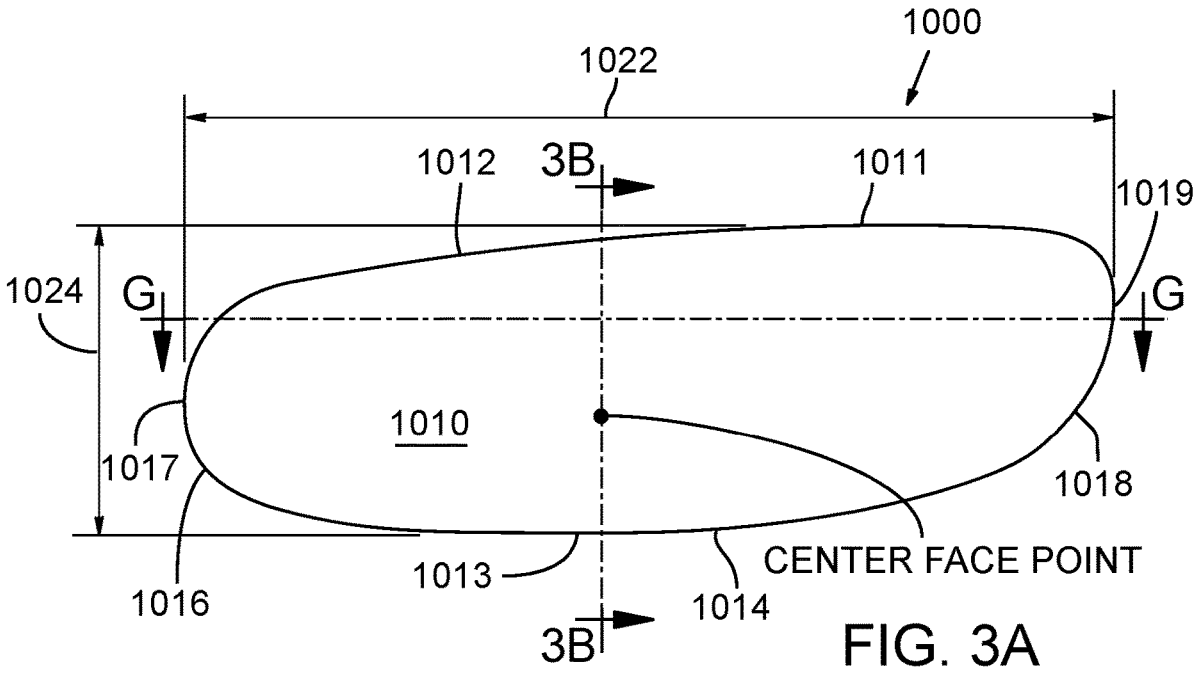
FIG. 3A is an inner side view of a face insert for a golf club head in accord with one embodiment of the current disclosure.

One embodiment of a face insert 1000 for a hybrid-type golf club head is seen with reference to FIG. 3A. One of skill in the art would understand that the teachings and embodiments of the current disclosure may be applicable to similar types of golf club heads, including fairway wood type golf club heads, driver type golf club heads, and irons, among others. The face insert 1000 has an inner surface 1010 and an outer surface 1009 (shown in FIG. 3B). The outer surface may be used for striking a golf ball when the face insert 1000 is connected to a club body as indicated above.

The face insert 1000 includes a top end 1012, a bottom end 1014, a heel end 1016, and a toe end 1018. In the current embodiment, the face insert 1000 does not have straight ends 1012,1014 such that a highest point 1011 and a lowest point 1013 can be seen at the extent of the top end 1012 and the bottom end 1014, respectively. Similarly, the face insert 1000 does not have ends 1016,1018 that are straight, so a heelwardmost point 1017 and a toewardmost point 1019 can be seen at the extent of the heel end 1016 and the toe end 1018, respectively. A length 1022 and height 1024 may be various dimensions in various embodiments. In various embodiments, length 1022 and height 1024 may be selected to provide maximum distance gains and/or to promote most consistent distance between center face and off-center strikes. In the current embodiment, the length 1022 is about 68 mm and the height 1024 is about 22.5 mm. In various embodiments, the length 1022 may be 65-70 mm and the height 1024 may be 20-25 mm. In further embodiments, the length 1022 may be 60-75 mm and the height 1024 may be 17-30 mm. The location of CF is indicated in FIG. 3A. Although the CF may not be in the geometric center of the face insert 1000, it may align more closely to the geometric center of the face 110 when implemented into a golf club head such as golf club head 100.

The inner surface 1010 may be about flat in various embodiments. In various embodiments, the inner surface 1010 may be curved at about the same curvature as the outer surface 1009 such that it includes similar bulge and roll profiles. In various embodiments, the inner surface 1010 may include various surface profile to define a variable thickness between the outer surface 1009 and the inner surface 1010.

Figure 3B:
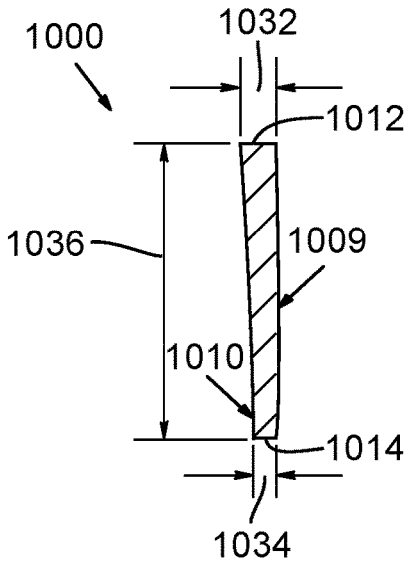
FIG. 3B is a cross-sectional view of the face insert of FIG. 3A taken in a plane indicated by line 3B-3B.

As seen with reference to FIG. 3B, the face insert 1000 includes a top end thickness 1032 that is a thickness of the face insert 1000 from the outer surface 1009 to the inner surface 1010 proximate the top end 1012. The face insert 1000 also includes a bottom end thickness 1034 that is a thickness of the face insert 1000 proximate the bottom end 1014. In the current embodiment, the top end thickness 1032 is about 2.50 mm. In various embodiments, the top end thickness 1032 may vary from about 2 mm to about 3 mm. In various embodiments, the top end thickness 1032 may be as little as 1.5 mm and as much as 4 mm. In the current embodiment, the bottom end thickness 1034 is about 1.70 mm. In various embodiments, the bottom end thickness 1034 may vary from about 1.25 mm to 2.0 mm. In various embodiments, the bottom end thickness 1034 may be as little as 1.0 mm and as much as 2.5 mm. A center face section height 1036 defines a height of the face insert 1000 at a location intersecting the CF as measured in the direction of the z-axis 206 (seen in FIG. 1A). In the current embodiment, the center face section height 1036 is about 21.5 mm. In various embodiments, the center face section height 1036 may be various distances from about 18 mm to about 25 mm, and may be greater in embodiments where large face size may be desirable.

Figure 4A:
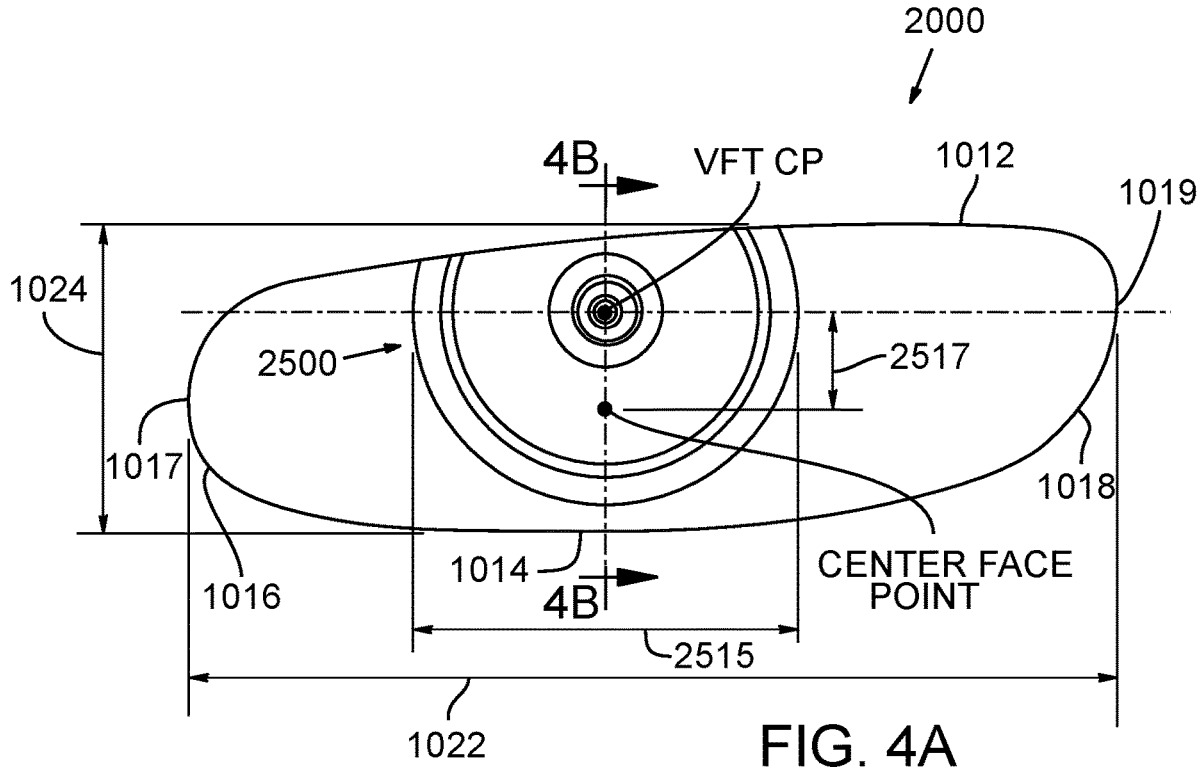
FIG. 4A is an inner side view of a face insert for a golf club head in accord with one embodiment of the current disclosure.

Another embodiment of a face insert 2000 is shown in FIG. 4A. The face insert 2000 includes overall dimensions similar to those of face insert 1000. For the sake of the disclosure, where embodiments are similarly drawn or noted to be of similar dimension, one of skill in the art would understand that features may be imported from one embodiment to another in accord with the scope and spirit of the disclosure. The face insert 2000 includes a VFT feature 2500. In the current embodiment, the VFT feature 2500 is a radially symmetrical VFT pattern. The VFT feature 2500 includes an overall dimension 2515 that is about 66.7 mm in the current embodiment. In the current embodiment, the overall dimension 2515 is a diameter, although in various embodiments various VFT features may not be circular in nature. The VFT feature 2500 includes a VFT center point (VFT CP) of the radially symmetrical VFT pattern. The VFT CP of the current embodiment is determined based on the center of the radial pattern. The VFT CP occurs at a midpoint of the overall dimension 2515. In various embodiments, the VFT CP may be determined based on geometry, mass density, thickness, or various other determinations as appropriate for the particular pattern. The VFT CP is located a distance 2517 above the CF. In the current embodiment, the distance 2517 is about 7.0 mm. In various embodiments, the VFT CP may be at various locations above the CF, including outside of the face insert 2000 such that only a bottom portion of the VFT pattern is included on the face insert 2000. The VFT CP in the current embodiment is about equidistant between the heelwardmost point 1017 and the toewardmost point 1019. In the current embodiment, the VFT CP is arranged directly above the CF, although in various embodiments the VFT CP and the VFT pattern may be located elsewhere on the face insert 2000.

Figure 4B:
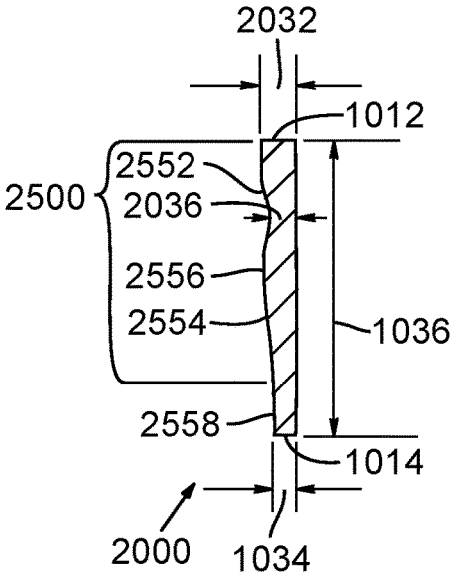
FIG. 4B is a cross-sectional view of the face insert of FIG. 4A taken in a plane indicated by line 4B-4B.

As seen with reference to FIG. 4B, the thickness of the face insert 2000 is variable from the top end 1012 to the bottom end 1014. In the current embodiment, a bottom end thickness 2034 is about 1.7 mm. In various embodiments, the bottom end thickness 2034 may vary from about 1.25 mm to 2.0 mm. In various embodiments, the bottom end thickness 2034 may be as little as 1.0 mm and as much as 2.5 mm. In the current embodiment, a top end thickness 2032 is about 2.4 mm. In various embodiments, the top end thickness 2032 may vary from about 2 mm to about 3 mm. In various embodiments, the top end thickness 2032 may be as little as 1.5 mm and as much as 4 mm. Unlike the face insert 1000, the VFT feature 2500 causes a variable thickness across the face insert 2000. A VFT CP thickness 2036 defines a thickness of the face insert 2000 proximate the VFT CP. In the current embodiment, the VFT CP thickness 2036 is about 2.0 mm, although it may vary from 1.0 mm to 4.0 mm in various embodiments. As can be seen, various transition regions 2552, 2554 provide radially sloped thickness regions. Additionally, a mantle region 2556 is an about flat region radially outward from the VFT CP. In the current embodiment, the mantle region 2556 intersects the top end 1012 such that the thickness of the mantle region 2556 is about the same as the top end thickness 2032. As such, the thickness of the VFT feature 2500 gradually increases from the VFT CP thickness 2036 radially outward from the VFT CP to the top end 1012. Beyond the mantle region 2556, the thickness of the face insert 2000 gradually decreases along the transition region 2554 until a thickness of about the same as the bottom end thickness 2034 is reached at a base region 2558. The thickness of the face insert 2000 then remains constant until the bottom end 1014.

Figure 5A:
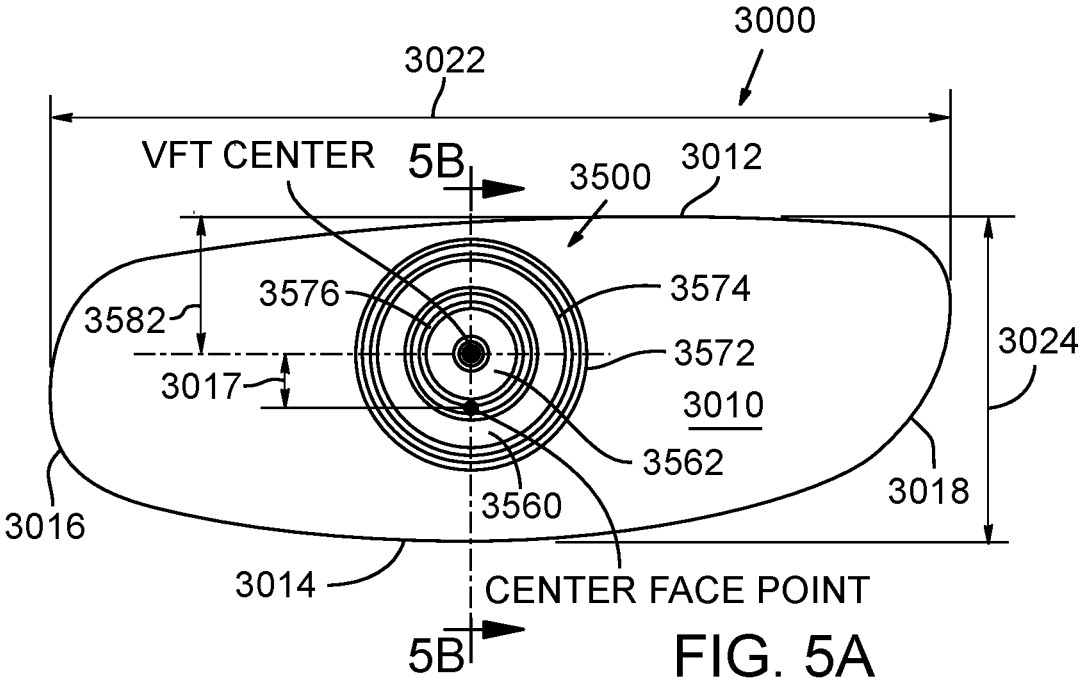
FIG. 5A is an inner side view of a face insert for a golf club head in accord with one embodiment of the current disclosure.
Figure 5B:
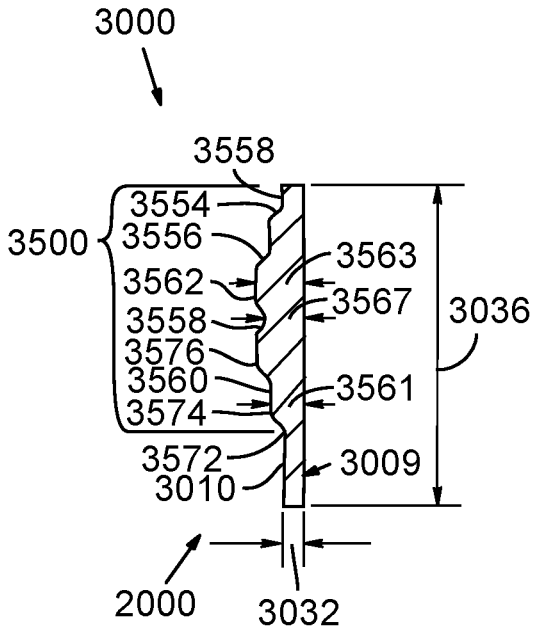
FIG. 5B is a cross-sectional view of the face insert of FIG. 5A taken in a plane indicated by line 5B-5B.

Another embodiment of a face insert 3000 is seen with reference to FIGS. 5A-5B. The face insert 3000 is defined along a length 3022 and a height 3024 that define the extent of the face insert 3000. In the current embodiment, the length 3022 is about 65 mm and the height 3024 is about 23.25 mm. In various embodiments, the length 3022 may fall in the ranges defined for length 1022 and the height 3024 may fall within the ranges defined for height 1024. Similarly, a center face section height 3036 may be about 23 mm, but may fall within the ranges defined for center face section height 1036 as mentioned above. The face insert 3000 is defined at a top end 3012, a bottom end 3014, a heel end 3016, and a toe end 3018. The face insert 3000 includes an outer surface 3009 and an inner surface 3010. The face insert 3000 includes a VFT feature 3500. The VFT feature 3500 is a radially symmetrical VFT profile include a VFT CP as in at least one previously discussed embodiments, although the shape and dimensions of the VFT feature 3500 differ in some ways from VFT features described elsewhere in this disclosure. In the current embodiment, a CF is seen in addition to the VFT CP. The VFT CP is located a distance 3517 from the CF. In the current embodiment, the distance 3517 is about 3.9 mm, although in various embodiments the distance 3517 may be at least 2 mm and up to relatively large distances, including embodiments wherein the VFT CP of the VFT feature 3500 is located above the top end 3012, as previously discussed with reference to prior embodiments.

The VFT feature 3500 is smaller in overall dimensions than the VFT feature 2500. The face insert 3000 includes a base region 3558 that is of a thickness 3032. The base region 3558 includes the thickness of the face insert 3000 as it would appear without a VFT pattern. The VFT feature 3500 is seen in profile view with specific reference to FIG. 5B. The VFT feature 3500 includes various transition regions 3554, 3556, 3558 that provide sloped interaction between flatter regions of the VFT feature 3500. The VFT feature 3500 includes a first mantle 3560 and a second mantle 3562. The VFT feature 3500 also may include a third mantle proximate the VFT CP, although it is not specifically called out in the current embodiment. In various embodiments, the third mantle may simply form from a depression in the second mantle 3562. A first mantle thickness 3561 defines a thickness of the face insert 3000 at the first mantle 3561. In various embodiments, the first mantle thickness 3561 may be 2.5 mm. In various embodiments, the first mantle thickness 3561 may be 2.7 mm. In various embodiments, the first mantle thickness 3561 may range from 2.0 mm to 3.0 mm. A second mantle thickness 3563 defines a thickness of the face insert 3000 at the second mantle 3562. In various embodiments, the second mantle thickness 3563 may be 3.5 mm. In various embodiments, the second mantle thickness 3563 may be 3.7 mm. In various embodiments, the second mantle thickness 3563 may range from 3.0 mm to 4.5 mm. Finally a VFT CP thickness 3567 is seen and may be 2.5 mm to 4.0 mm in various embodiments. In various embodiments, the VFT CP thickness 3567 may be a thickness of a VFT CP mantle or simply of a point at the VFT CP.

As can be seen with reference to FIG. 5A, the VFT feature 3500 is radial. A radius of the VFT feature 3500 as measured from the VFT CP to an end 3572 of the VFT feature 3500 is about 8.25 mm and may be 7 mm to 9 mm in various embodiments. A radius as measured from the VFT CP to an end 3574 of the first mantle 3560 is about 6.8 mm and may be 6 mm to 8 mm in various embodiments. A radius as measured from the VFT CP to an end 3576 of the second mantle 3562 is about 3.25 mm and may be 2.5 mm to 4.5 mm in various embodiments. The VFT CP is a distance 3582 from the top end 3012 of the face insert 3000. In the current embodiment, the distance 3582 is about 9.5 mm. Because the outermost radius of the VFT feature 3500 is about 8.25 mm, there remains a gap of about 1.25 mm between the top end 3012 and the end 3572. In various embodiments, the distance 3582 may range from 8 mm to 10.5 mm.

The location and size of the VFT feature 3500 may aid in defining the effectiveness of the VFT feature 3500. For any face insert with a VFT pattern, a VFT location ratio is defined as a ratio of two dimensions relative to the VFT. The first dimension is the largest dimension of the VFT from the VFT's center point to one end. The second dimension is the distance from a center point of the VFT feature to the top end of the face insert. The VFT location ratio gives a quantitative measure of the size of the VFT feature as related to the VFT feature's proximity to the top end of the face insert. In the current embodiment, the largest radial dimension of the VFT feature 3500 is 8.25 mm and the distance 3582 is 9.5 mm such that the VFT location ratio of the current embodiment is about 0.868. Another measure of the location and effectiveness of a VFT feature includes a ratio of distance to center face as compared to distance to the top line. As quantified, a VFT location percentage is defined as the distance of the VFT CP to CF as compared to the total distance from CF to the top end. In the current embodiment, the distance 3576 is about 3.9 mm and the distance 3582 is about 9.5 mm. As such, the VFT location percentage is calculated as 3.9/(3.9+9.5)=29.10%. In various embodiments, various ratios of such dimensions may be combined to help further define the size, location, and effectiveness of the VFT features of various face inserts. Additionally, various ratios and percentages may be combined. For example, a VFT location product is determined using a combination of VFT location percentage as multiplied by VFT location ratio may help define the VFT feature in various embodiments. In the current embodiment, a VFT location ratio is about 0.868, and a VFT location percentage is about 29.10% such that the VFT location product is about 0.253. In various embodiments, the dimensions mentioned above may be larger or smaller depending upon the application. Although hard edges are seen between the various mantles and transition regions, one of skill in the art would understand that such features may be gradually sloped or curved to reduce stress concentration or to aid in manufacturing, among other motivations.

Figure 6A:
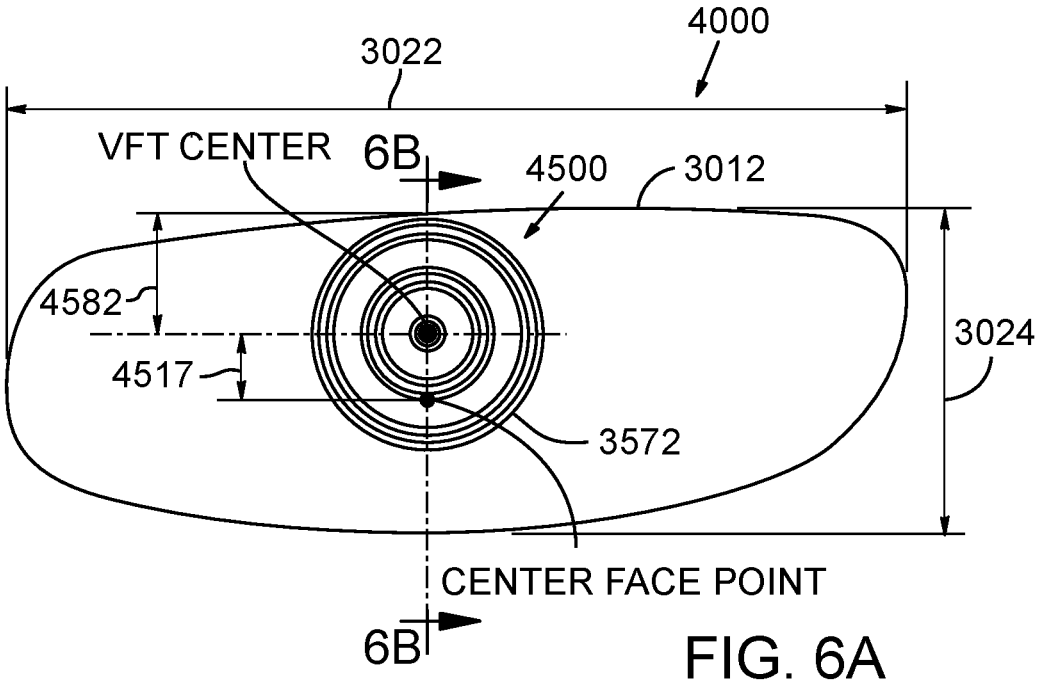
FIG. 6A is an inner side view of a face insert for a golf club head in accord with one embodiment of the current disclosure.
Figure 6B:
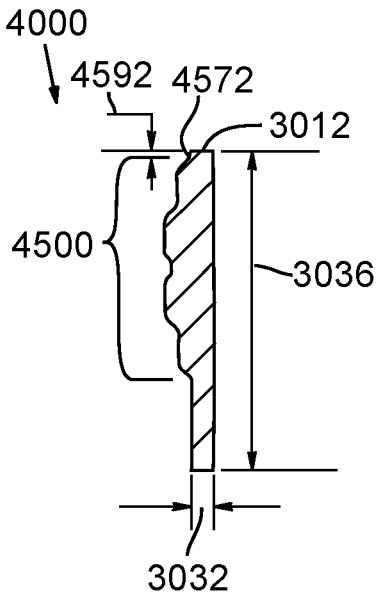
FIG. 6B is a cross-sectional view of the face insert of FIG. 6A taken in a plane indicated by line 6B-6B.

Another embodiment of a face insert 4000 is seen with reference to FIGS. 6A-6B. The face insert 4000 includes dimensions similar to those of face insert 3000. For the sake of the disclosure, where embodiments are similarly drawn or noted to be of similar dimension, one of skill in the art would understand that features may be imported from one embodiment to another in accord with the scope and spirit of the disclosure. The face insert 4000 includes a VFT feature 4500 that includes the same dimensions as VFT feature 3500 but for some specifics of its location. The VFT CP is a distance 4582 from the top end 3012 of the face insert 4000. In the current embodiment, the distance 4582 is about 8.55 mm. The VFT CP is located a distance 4517 from the CF. In the current embodiment, the distance 4517 is about 4.9 mm, although in various embodiments the distance 4517 may be at least 2 mm and up to relatively large distances, including embodiments wherein the VFT CP of the VFT feature 4500 is located above the top end 3012, as previously discussed with reference to prior embodiments. As seen with specific reference to FIG. 6B, the end 3572 of the VFT feature 4500 is a separation distance 4592 from the top end 3012. In the current embodiment, the separation distance 4592 is only about 0.30 mm.

As such, although the VFT feature 4500 is dimensionally similar to the VFT feature 3500, the VFT feature 4500 includes different properties. The VFT location ratio is calculated using the largest radial dimension of the VFT feature 4500 (8.25 mm) divided by the distance from the VFT CP to the top end 3012 (distance 4582, 8.55 mm). In th The VFT CP is located a distance 3517 from the CF. In the current embodiment, the distance 3517 is about 3.9 mm, although in various embodiments the distance 3517 may be at least 2 mm and up to relatively large distances, including embodiments wherein the VFT CP of the VFT feature 3500 is located above the top end 3012, as previously discussed with reference to prior embodiments.

In the current embodiment, the VFT location ratio is about 0.965. The VFT location percentage is 4.9/(4.9+8.55), or about 36.43%. The VFT location product is calculated as 36.43% of 0.965, or 0.667.

Figure 7A:
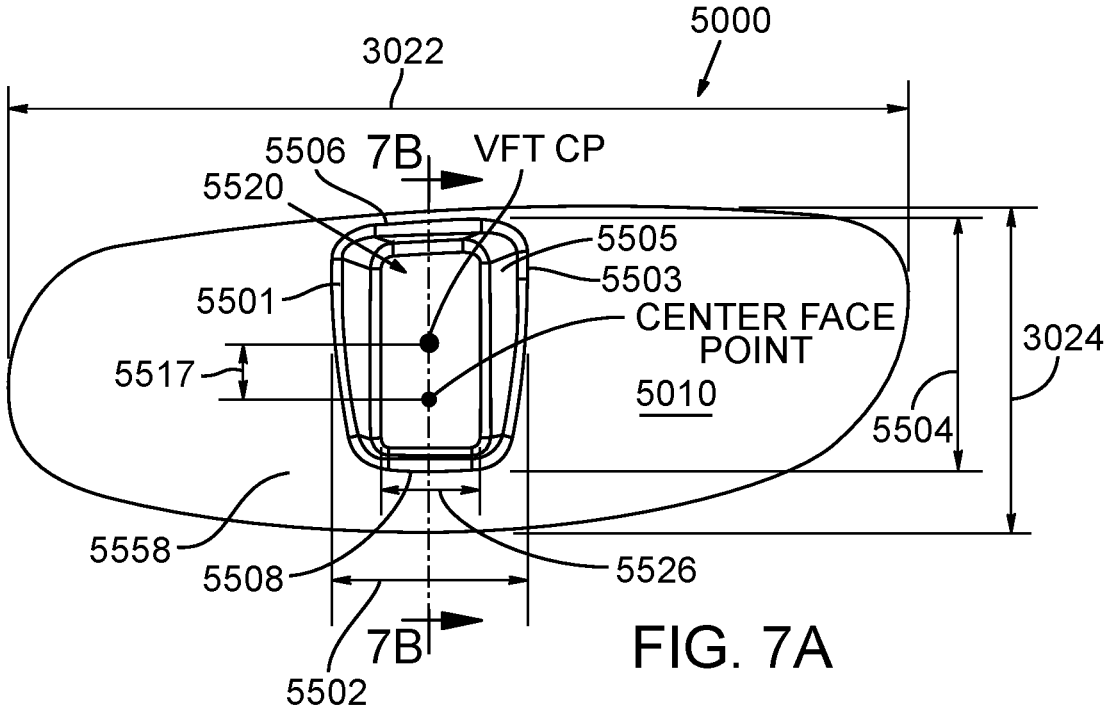
FIG. 7A is an inner side view of a face insert for a golf club head in accord with one embodiment of the current disclosure.
Figure 7B:
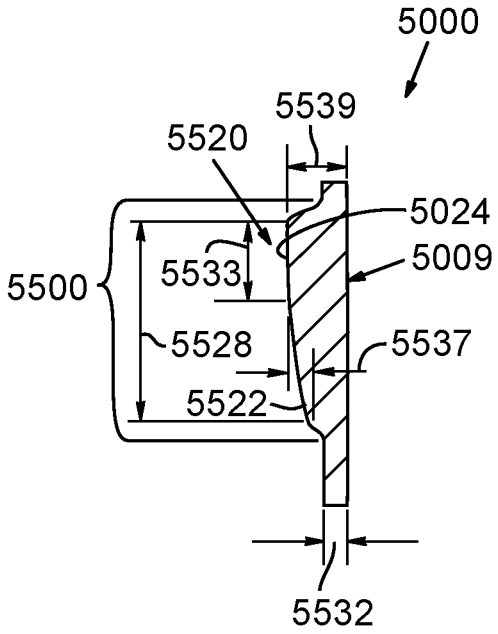
FIG. 7B is a cross-sectional view of the face insert of FIG. 7A taken in a plane indicated by line 7B-7B.

Another embodiment of a face insert 5000 is seen with reference to FIGS. 7A-7B. The face insert 5000 includes general dimensions similar to those of face inserts 3000, 4000. The face insert 5000 includes a VFT feature 5500 that is not radially symmetrical. The VFT feature 5500 of the current embodiment is about rectangular in shape and is defined by a heel-toe extent 5502 measured from a heel end 5501 to a toe end 5503 of about 14.0 mm and a crown-sole extent 5504 measured from a top end 5506 to a bottom end 5508 of about 18.0 mm. In the current embodiment, the overall dimension of the VFT feature 5500 is the crown-sole extent 5504, although in various embodiments the heel-toe extent 5502 may be large than the crown-sole extent. As can be seen, the VFT feature 5500 includes various regions of transition from relatively thin to relatively thick portions. A first transition region 5505 provides a transition from a base region 5558 that is about constant thickness from an outer surface 5009 to an inner surface 5010 of the face insert 5000. A central portion 5520 of the VFT feature 5500 includes a sloped region 5522 and a constant thickness region 5524 such that a thickest region of the VFT feature 5500 is located proximate to the top end 5506. The central portion 5520 is defined by a heel-toe dimension 5526 of about 7.2 mm and a crown-sole dimension 5528 of about 13.8 mm. As can be seen with specific reference to FIG. 7B, the constant thickness region 5524 is of a dimension 5533 as measured in the crown-sole direction of about 1.80 mm. The central portion 5520 changes the thickness of the face insert 5000 by a dimension 5537 of about 1.85 mm. A thickness 5032 of the face insert 5000 in the base region 5558 is about 1.7 mm, with thickness ranges similar to those of thickness 3032. The face insert 5000 has a maximum thickness at a thickness 5539 of the constant thickness region 5524. The VFT feature 5500 includes a VFT CP. The VFT CP is located in the geometric center of the VFT feature 5500. The center point of the VFT is located at a midpoint between the bottom end 5508 and the top end 5506. The VFT CP is also located at a midpoint between the heel end 5501 and the toe end 5503. In various embodiments, a mass-based VFT CP may be used to characterize the VFT. The VFT CP is offset from the CF by a distance 5517 of about 3.4 mm.

For the current embodiment, the VFT location ratio is about 0.90 because the major distance of the VFT feature 5500 is about 18.0 mm and the distance from the VFT CP to the top end 3012 is about 10.0 mm. In the current embodiment, the VFT location percentage is about 3.4/(4.9+8.55)=25.27%. The VFT location product is about 0.2274.

Figure 8:
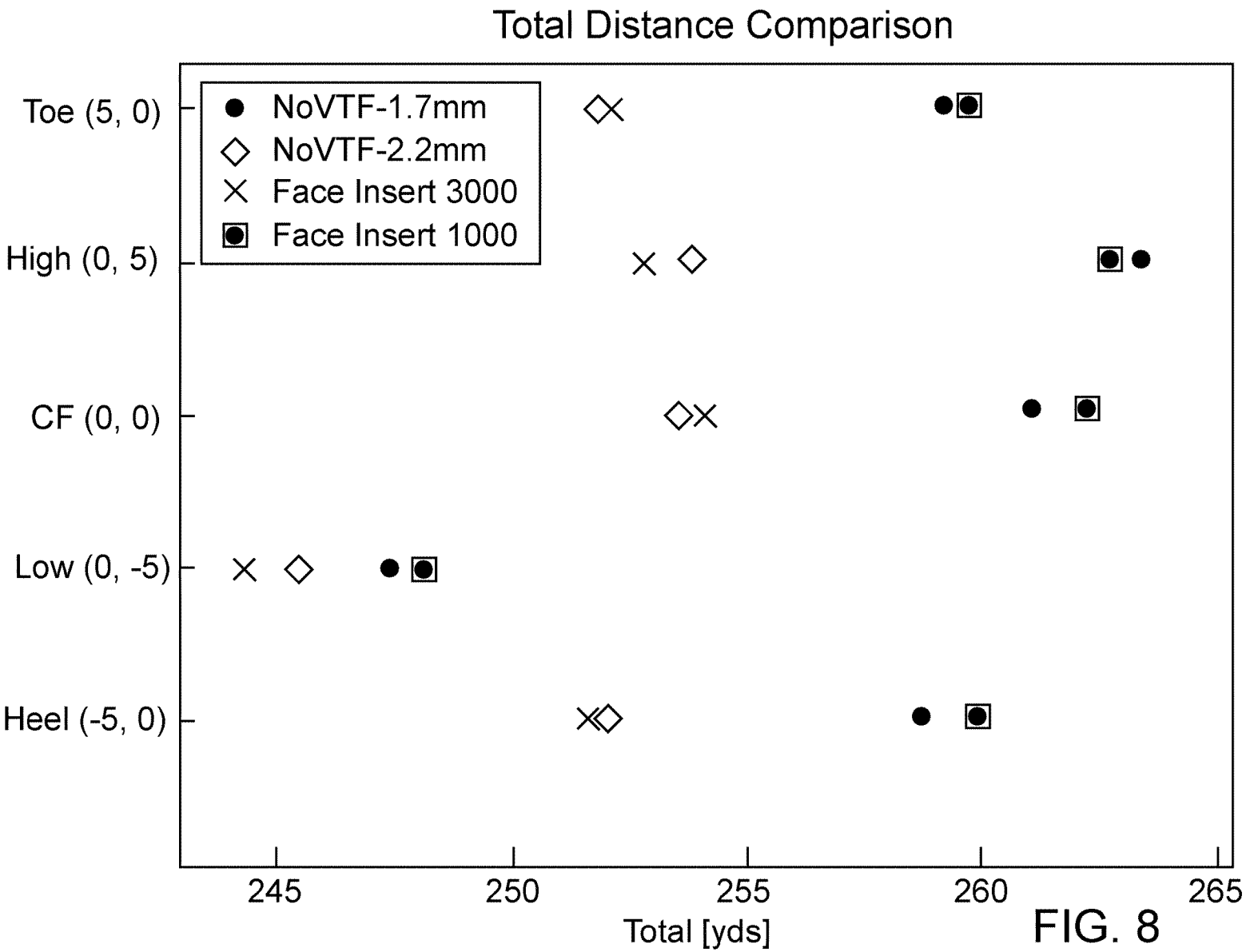
FIG. 8 is a graph displaying comparisons of various embodiments of face inserts in accord with the current disclosure.
Figure 9:
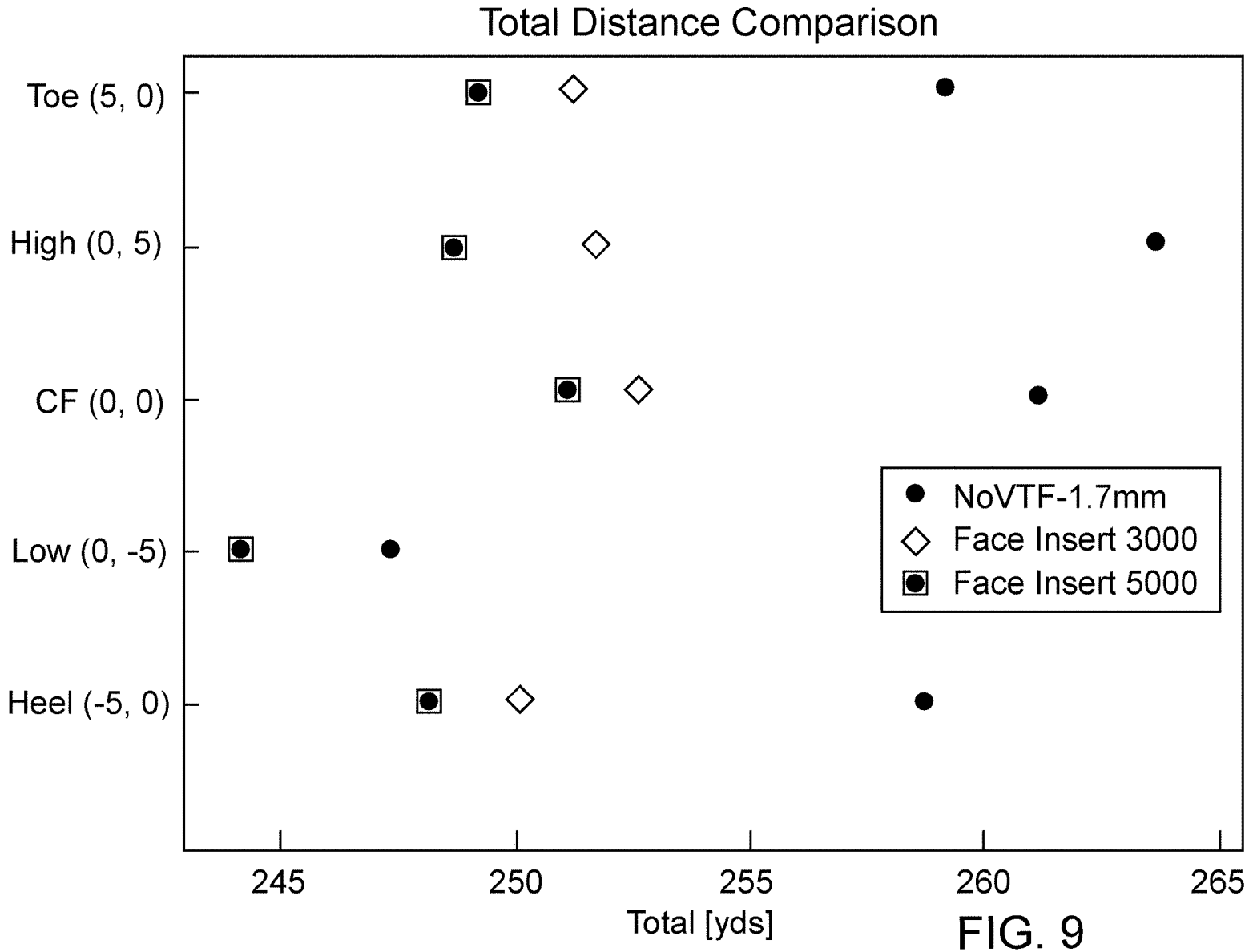
FIG. 9 is a graph displaying comparisons of various embodiments of face inserts in accord with the current disclosure.
Figure 10:
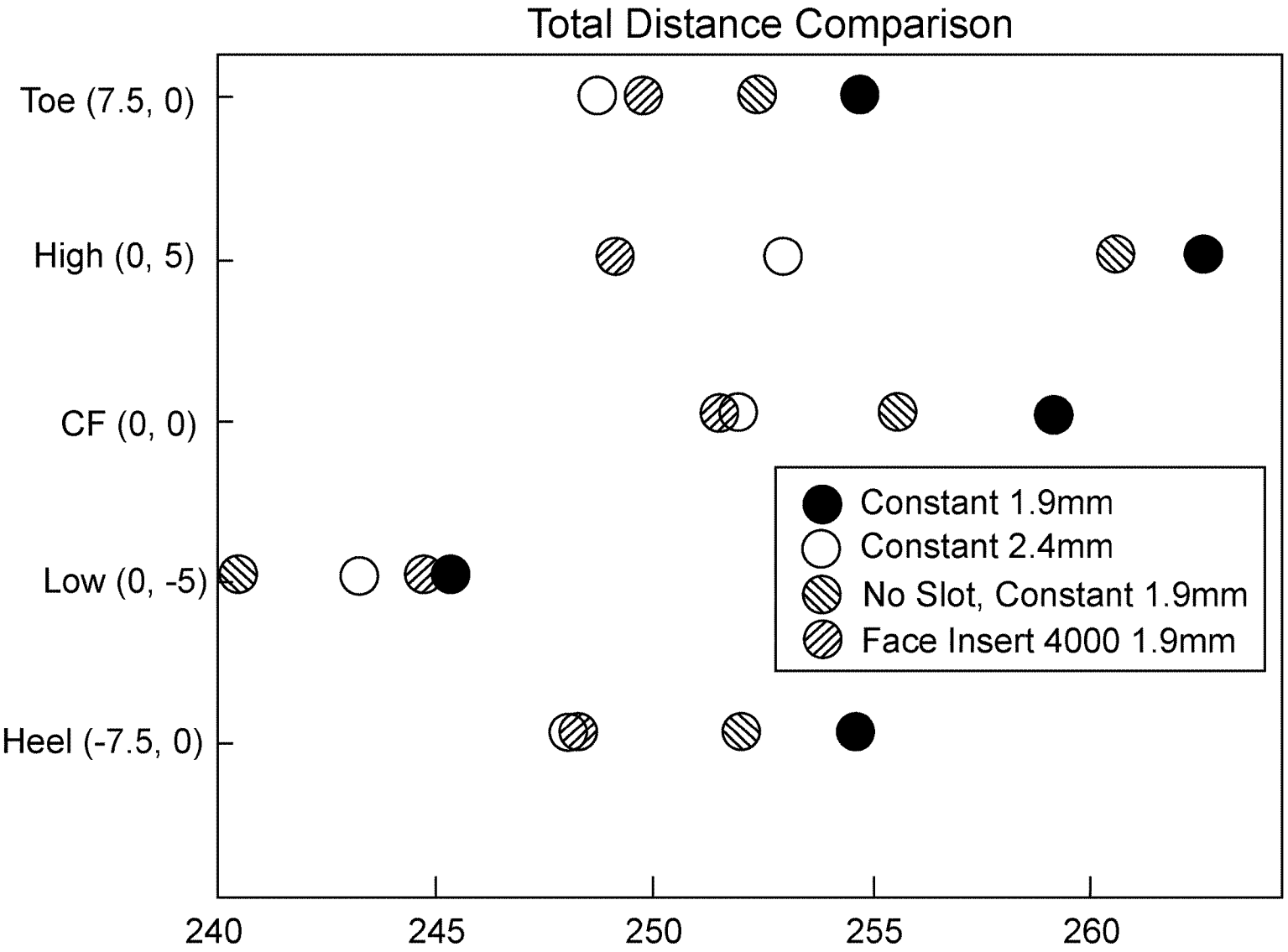
FIG. 10 is a graph displaying comparisons of various embodiments of face inserts in accord with the current disclosure.

A comparison of total distances of the various embodiments of face inserts is included with reference to FIGS. 8-10. The distances shown in figures of the current disclosure are based on finite element analysis (FEA) simulations with a hybrid golf club that has a loft of 18.7 degrees and impact conditions of 107 mph club head speed, 4° de-lofting at impact, 0.5° downward path, and 0° scoreline relative to ground (score lines parallel to ground plane). This is experimentally verified with similar setup conditions in the methodology as follows. Utilizing a robot and a head tracker to set up the club for a center face shot. The impact conditions are 107±1 mph club head speed, 4±1° de-lofting, 0±1° scoreline lie angle relative to ground, 2±1° open face angle relative to target line, 2±1° inside-to-outside head path, and 0.5±1° downward path. Once the robot is set up to achieve these head impact conditions, the ball is placed on a tee for center face impact within ±1 mm. At least 10 shots are taken at the center face, and the average distance is measured (both carry and total). The average carry for center face is called $DC_{CF}$ and the average total distance for center face is called $DT_{CF}$. Next, the tee is moved to another impact location (i.e., 5±1 mm heel of center face), and 10 more shots are taken with the average carry and total distance measured. The average carry for 5 mm heel is called $DC_{5H}$ and the average total distance for center face is called $DT_{5H}$. This is repeated for each of the other impact locations where the average carry and total distance are measured based on at least 10 shots from each of these tee positions and the same head presentation as for the center face shot. These are called $DC_{5T}$ and $DT_{5T}$ for 5 mm toe, $DC_{5A}$ and $DT_{5A}$ for 5 mm above center face, and $DC_{5B}$ and $DT_{5B}$ for 5 mm below center face). After measuring average distances for each of the impact locations, the carry range, $DC_{RANGE}$, (maximum average carry—minimum average carry) are determined, and the total distance range, $DT_{RANGE}$, (maximum average total—minimum average total) are calculated. Furthermore, the standard deviation of carry, $DC_{SDEV}$, is calculated from $DC_{CF}$, $DC_{5H}$, $DC_{5T}$, $DC_{5A}$ and $DC_{5B}$; the standard deviation of total distance, $DT_{SDEV}$, is calculated from ($DT_{CF}$, $DT_{5H}$, $DT_{5T}$, $DT_{5A}$ and $DT_{5B}$).

A suitable robot may be obtained from Golf Laboratories, Inc., 2514 San Marcos Ave. San Diego, Calif., 92104. A suitable head tracker is GC2 Smart Tracker Camera System from Foresight Sports, 9965 Carroll Canyon Road, San Diego, Calif. 92131. Other robots or head tracker systems may also be used and may achieve these impact conditions. A suitable testing golf ball is the TaylorMade Lethal golf ball, but other similar thermoset urethane covered balls may also be used. The preferred landing surface for total distance measurement is a standard fairway condition. Also, the wind should be less than 4 mph average during the test to minimize shot to shot variability.

With reference to FIG. 8, constant thickness face inserts at 1.7 mm and 2.2 mm are used as controls for comparison. Each embodiment of FIGS. 8 and 9 include COR features as disclosed elsewhere in this disclosure. Distances for strike locations are included at center face (0,0), 5 mm toward the toe (5,0), 5 mm high (0,5), 5 mm low (0,−5), and 5 mm toward the heel (−5,0). Face insert 3000 in the embodiment of FIG. 8 includes a thickness 3032 of 1.6 mm. As can be seen, the performance of face insert 3000 is similar to that of a face insert without a VFT feature that is constant 2.2 mm thickness. However, the face insert 3000 is of a mass that is between 5-10 grams less than a constant thickness face insert at 2.2 mm. Similarly, face insert 1000 includes performance similar to a face insert without a VFT feature that is constant 1.7 mm thickness, but face insert 1000 provides somewhat better performance on low face strikes and does not see as high variability on high face strikes. Additionally, face insert 1000 may include durability advantages not seen in constant thickness face inserts at 1.7 mm.

With reference to FIG. 9, face insert 3000 and face insert 5000 are compared to the constant face insert at 1.7 mm for total distance. Face insert 3000 in the embodiment of FIG. 9 includes a thickness 3032 of 1.7 mm. As can be seen, a modification to thickness changes the performance of face insert 3000. Although face insert 3000 is more consistent than the constant thickness face insert at 1.7 mm, face insert 5000 includes distances varying from a maximum of about 252 yards to a minimum of about 245 yards. As such, face insert 5000 maintains a strongly consistent distance. Further, as compared to the constant thickness face insert at 2.2 mm (see FIG. 8)—which varied in distance from about 255 yards to about 245 yards—face insert 5000 shows tighter dispersion of distances and saves 5-10 grams mass over the constant thickness face insert at 2.2 mm.

Figure 14:
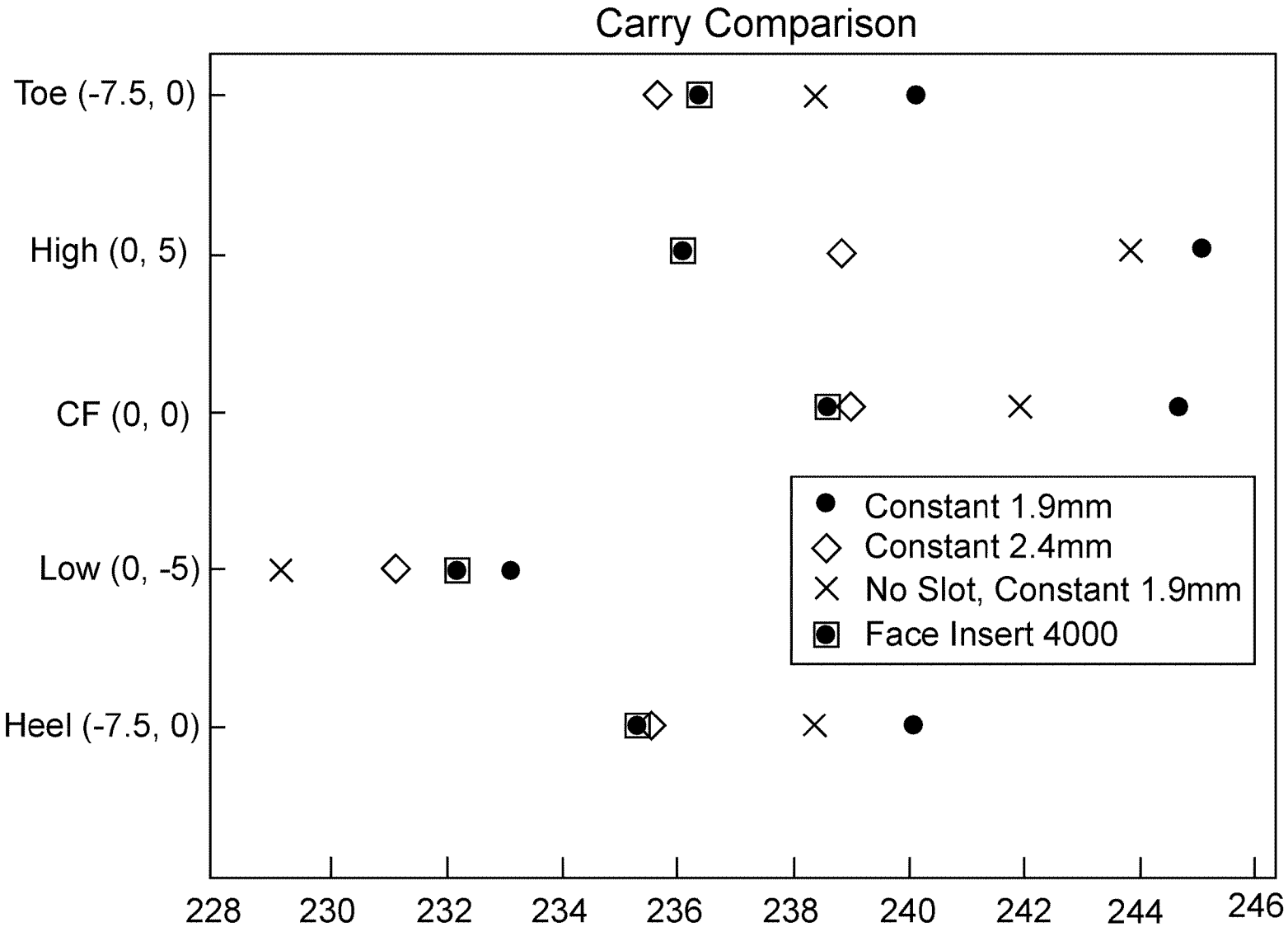
FIG. 14 is a graph displaying an aspect of comparisons of various embodiments of face inserts as previously compared with respect to FIG. 10.

As seen with reference to FIG. 10, face insert 4000 is compared to face inserts of constant thickness at 1.9 mm and 2.4 mm with CORF and a face insert of constant thickness at 1.9 mm without a CORF for total distance. Performance of face insert 4000 is noticeably more consistent than various embodiments shown in FIG. 10. A similar comparison of carry distance is shown with reference to FIG. 14. As shown with reference to FIG. 11, the embodiments of the golf club head incorporating the CORF 300 and face insert 4000 provides a standard deviation amongst shots of 2.2 yards, which is smaller than all other embodiments. Additionally, the only embodiment approaching the performance described above is the embodiment incorporating CORF 300 and a constant face thickness at 2.4 mm. However, the constant face thickness face insert of 2.4 mm is over 3 grams heavier than face insert 4000. As seen with reference to FIG. 12, face insert 4000 achieves tightest distance dispersion by combining spin, launch angle, and ball speed (among other factors) that vary depending on the location of the strike on the face. As such, face insert 4000—as one embodiment explaining exemplary benefits of the embodiments of the current disclosure—provides a near optimization of the various shot features to provide consistent distance on various shot types. Additional data—including the data of FIGS. 10 and 14—is included in FIG. 15.

Figure 13:
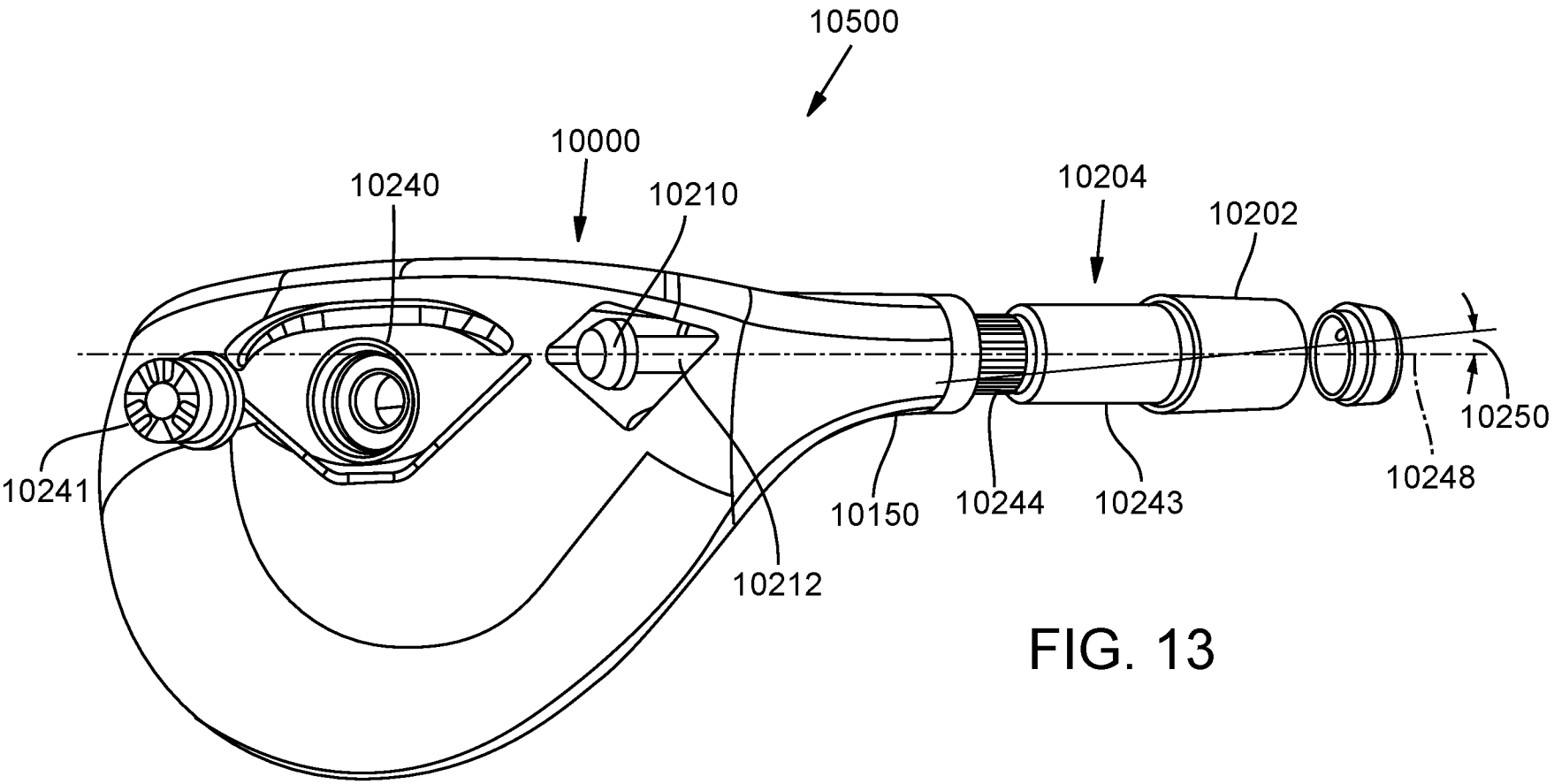
FIG. 13 is a perspective view of a golf club head assembly in accord with one embodiment of the current disclosure.

A golf club head 10000 is shown with reference to FIG. 13. The golf club head 10000 is part of a golf club assembly 10500 that includes flight control technology. FIG. 13 illustrates a removable shaft system having a ferrule 10202 having a sleeve bore (not shown) within a sleeve 10204. A shaft (not shown) is inserted into the sleeve bore and is mechanically secured or bonded to the sleeve 10204 for assembly into a golf club. The sleeve 10204 further includes an anti-rotation portion 10244 at a distal tip of the sleeve 10204 and a threaded bore (not shown) on the end of the sleeve 10204 for engagement with a screw 10210 that is inserted into a sole opening 10212 defined in the club head 10000. In one embodiment, the sole opening 10212 is directly adjacent to a sole non-undercut portion. The anti-rotation portion 10244 of the sleeve 10204 engages with an anti-rotation collar (not shown) which is bonded or welded within a hosel 10150 of the golf club head 10000. The adjustable loft, lie, and face angle system is described in U.S. patent application Ser. No. 12/687,003 (now U.S. Pat. No. 8,303,431), which is incorporated herein by reference in its entirety. The golf club assembly 10500 includes a weight 10241 for the weight port 10240. Although not shown, the shaft and a grip may be included as part of the golf club assembly 10500.

The embodiment shown in FIG. 13 includes an adjustable loft, lie, or face angle system that is capable of adjusting the loft, lie, or face angle either in combination with one another or independently from one another. For example, a first portion 10243 of the sleeve 10204, the sleeve bore 10242, and the shaft collectively define a longitudinal axis 10246 of the assembly. The sleeve 10204 is effective to support the shaft along the longitudinal axis 10246, which is offset from a longitudinal axis 10248 of the by offset angle 10250. The longitudinal axis 10248 is intended to align with the SA (seen in FIG. 1B). The sleeve 10204 can provide a single offset angle 10250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 10204 can be rotated to provide various adjustments to the golf club assembly 10500 as described in U.S. Pat. No. 8,303,431. One of skill in the art would understand that the system described with respect to the current golf club assembly 10500 can be implemented with various embodiments of the golf club heads of the current disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A golf club head comprising:

a golf club head body defined by a crown, a sole, a skirt, and a face, the golf club head body defining an interior cavity;

the face including a toe end, a heel end, a crown end, and a sole end, the face defining a thickness from an outer surface to an inner surface of the face, wherein the thickness of the face is variable;

the face including a geometric center that defines an origin of a coordinate system in which an x-axis is tangential to the face at a center face and is parallel to a ground plane when the golf club head is in a normal address position, a y-axis extending perpendicular to the x-axis and parallel to the ground plane, and a z-axis extending perpendicular to the ground plane, wherein a positive x-axis extends toward the toe end from the origin, a positive y-axis extends rearwardly from the origin, and a positive z-axis extends upwardly from the origin;

the crown coupled to the crown end of the face, the sole coupled to the sole end of the face, and the skirt coupled to the sole and the crown;

the golf club head body defining a trailing edge being a rearward most edge of the golf club head body and the golf club head body defining a leading edge being a forwardmost edge of the golf club head body;

wherein the crown end of the face having a crown end face thickness defined as a thickness of the face from an outer surface of the face to an inner surface of the face proximate the crown end;

wherein the sole end of the face having a sole end face thickness defined as a thickness of the face from an outer surface of the face to an inner surface of the face proximate the sole end;

wherein a distance from the leading edge to the trailing edge is at most 97 mm;

a weight pad located on the sole within the interior cavity and positioned proximate the face in a forward portion of the sole, wherein the weight pad includes an overhang portion that extends forward from the weight pad toward the face such that the overhang portion of the weight pad overhangs an interior sole surface, wherein a lower surface of the overhang portion and the interior sole surface are spaced apart by an offset distance and the offset distance is at least 0.2 mm;

wherein the golf club head is one of a fairway type golf club head and a hybrid type golf club head;

wherein a forwardmost portion of the weight pad is offset from the face no more than 12.5 mm; and wherein a loft of the golf club head is at least 14.5 degrees.

2. The golf club head of claim 1, wherein a forwardmost portion of the weight pad is offset from the leading edge no more than 10 mm.

3. The golf club head of claim 1, wherein a forwardmost portion of the weight pad is offset from the leading edge between 3-7 mm.

4. The golf club head of claim 1, further comprising a weight port formed in the golf club head and a weight configured to be retained at least partially within the weight port.

5. The golf club head of claim 4, wherein the weight port is formed in the weight pad.

6. The golf club head of claim 1, wherein an average thickness of the face above the center face is greater than an average thickness of the face below the center face.

7. The golf club head of claim 6, wherein the face thickness includes a variable face thickness feature (VFT feature), the VFT feature being a symmetrical pattern.

8. The golf club head of claim 6, wherein the face thickness includes a variable face thickness feature (VFT feature), the VFT feature being asymmetrical.

9. The golf club head of claim 6, wherein a minimum distance from a ground plane to an underside surface of the overhang portion is no more than 10 mm.

10. The golf club head of claim 6, wherein a minimum thickness of the overhang portion is no more than 10 mm.

11. The golf club head of claim 6, wherein a thickness of the overhang portion ranges between 2-10 mm.

12. The golf club head of claim 6, wherein the face including a variable face thickness feature (VFT feature) having a center point (CP), the face including a geometric center face (CF), the VFT feature CP being a distance D of at least 3 mm from the CF.

13. The golf club head of claim 6, further comprising an adjustable head-shaft connection assembly that is operable to adjust at least one of a loft angle, a lie angle, and a face angle of a golf club formed when the golf club head is attached to a golf club shaft via the head-shaft connection assembly.

14. The golf club head of claim 6, wherein the crown end thickness of the face ranges between 1.5 mm and 4 mm.

15. A golf club head comprising:

a golf club head body defined by a top portion, a bottom portion, a toe portion, a heel portion, and a face, the golf club head body defining an interior cavity;

the face including a toe end, a heel end, a top end, and a bottom end, the face defining a thickness from an outer surface of the face to an inner surface of the face, wherein the thickness of the face is variable;

the face including a geometric center that defines an origin of a coordinate system in which an x-axis is tangential to the face at a center face and is parallel to a ground plane when the golf club head is in a normal address position, a y-axis extending perpendicular to the x-axis and parallel to the ground plane, and a z-axis extending perpendicular to the ground plane, wherein a positive x-axis extends toward the toe end from the origin, a positive y-axis extends rearwardly from the origin, and a positive z-axis extends upwardly from the origin;

the top portion of the golf club head body coupled to the top end of the face, the bottom portion golf club head body coupled to the bottom end of the face, the toe portion of the golf club head body coupled to the toe end of the face, and the heel portion of the golf club head body coupled to the heel end of the face;

the golf club head body defining a trailing edge being a rearward most edge of the golf club head body and the golf club head body defining a leading edge being a forwardmost edge of the golf club head body;

wherein the top end of the face having a top end face thickness defined as a thickness of the face from an outer surface of the face to an inner surface of the face proximate the top end;

wherein the bottom end of the face having a bottom end face thickness defined as a thickness of the face from an outer surface of the face to an inner surface of the face proximate the bottom end;

wherein a distance from the leading edge to the trailing edge is at most 97 mm;

a weight pad located within the interior cavity and coupled to the bottom portion of the golf club head body and positioned proximate the face in a forward portion of the bottom portion, wherein the weight pad includes an overhang portion that extends forward from the weight pad toward the face such that the overhang portion of the weight pad overhangs an interior bottom portion surface, wherein a lower surface of the overhang portion and the interior bottom portion surface are spaced apart by an offset distance and the offset distance is at least 0.2 mm;

wherein a forwardmost portion of the weight pad is offset from the face no more than 12.5 mm;

wherein a loft of the golf club head is at least 14.5 degrees; and wherein in a y-z plane passing through the origin the top end face thickness is greater in thickness than the bottom end face thickness.

16. The golf club head of claim 15, wherein the top end thickness of the face ranges between 1.5 mm and 4 mm;

wherein an average thickness of the face above the center face is greater than an average thickness of the face below the center face; and wherein a minimum distance from a ground plane to an underside surface of the overhang portion is no more than 10 mm.

17. The golf club head of claim 16, wherein the face thickness includes a variable face thickness feature (VFT feature) and the VFT feature being asymmetrical.

18. The golf club head of claim 15, further comprising an adjustable head-shaft connection assembly that is operable to adjust at least one of a loft angle, a lie angle, and a face angle of a golf club formed when the golf club head is attached to a golf club shaft via the head-shaft connection assembly.

19. A golf club head comprising:

a golf club head body defined by a top portion, a bottom portion, a toe portion, a heel portion, and a face, the golf club head body defining an interior cavity;

the face including a toe end, a heel end, a top end, and a bottom end, the face defining a thickness from an outer surface of the face to an inner surface of the face, wherein the thickness of the face is variable;

the face including a geometric center that defines an origin of a coordinate system in which an x-axis is tangential to the face at a center face and is parallel to a ground plane when the golf club head is in a normal address position, a y-axis extending perpendicular to the x-axis and parallel to the ground plane, and a z-axis extending perpendicular to the ground plane, wherein a positive x-axis extends toward the toe end from the origin, a positive y-axis extends rearwardly from the origin, and a positive z-axis extends upwardly from the origin;

the top portion of the golf club head body coupled to the top end of the face, the bottom portion golf club head body coupled to the bottom end of the face, the toe portion of the golf club head body coupled to the toe end of the face, and the heel portion of the golf club head body coupled to the heel end of the face;

the golf club head body defining a trailing edge being a rearward most edge of the golf club head body and the golf club head body defining a leading edge being a forwardmost edge of the golf club head body;

wherein the top end of the face having a top end face thickness defined as a thickness of the face from an outer surface of the face to an inner surface of the face proximate the top end;

wherein the bottom end of the face having a bottom end face thickness defined as a thickness of the face from an outer surface of the face to an inner surface of the face proximate the bottom end;

wherein a distance from the leading edge to the trailing edge is at most 97 mm;

a weight pad located within the interior cavity and coupled to the bottom portion of the golf club head body and positioned proximate the face in a forward portion of the bottom portion, wherein the weight pad includes an overhang portion that extends forward from the weight pad toward the face such that the overhang portion of the weight pad overhangs an interior bottom portion surface, wherein a lower surface of the overhang portion and the interior bottom portion surface are spaced apart by an offset distance and the offset distance is at least 0.2 mm;

wherein a forwardmost portion of the weight pad is offset from the face no more than 12.5 mm;

wherein a loft of the golf club head is at least 14.5 degrees; and wherein in a y-z plane passing through the origin the top end face thickness is greater in thickness than the bottom end face thickness and the bottom end face thickness is no less than 1.0 mm and no more than 2.5 mm.

20. The golf club head of claim 19, wherein the top end thickness of the face ranges between 1.5 mm and 4 mm;

wherein an average thickness of the face above the center face is greater than an average thickness of the face below the center face; and wherein a minimum distance from a ground plane to an underside surface of the overhang portion is no more than 10 mm.

* * * * *